US006050850A

United States Patent [19]

Crane, Jr. et al.

[11] Patent Number: 6,050,850

[45] Date of Patent: Apr. 18, 2000

[54] ELECTRICAL CONNECTOR HAVING STAGGERED HOLD-DOWN TABS

[75] Inventors: Stanford W. Crane, Jr.; Lakshminarasimha Krishnapura; Arindum Dutta; Kevin Link, all of Boca Raton, Fla.

[73] Assignee: The Panda Project, Boca Raton, Fla.

[21] Appl. No.: 08/911,283

[22] Filed: Aug. 14, 1997

[51] Int. Cl.[7] ..... H01R 13/73

[52] U.S. Cl. ..... 439/569; 539/680

[58] Field of Search ..... 439/569–573, 439/680, 681

[56] References Cited

U.S. PATENT DOCUMENTS

| | | | |
|---|---|---|---|
| 3,601,770 | 8/1971 | Bowley . | |
| 4,202,593 | 5/1980 | Abernethy et al. | 439/569 |
| 4,274,700 | 6/1981 | Keglewitsch et al. | 339/192 R |
| 5,575,688 | 11/1996 | Crane, Jr. | 439/660 |
| 5,634,821 | 6/1997 | Crane, Jr. | 439/660 |
| 5,641,309 | 6/1997 | Crane, Jr. | 439/660 |

FOREIGN PATENT DOCUMENTS 0749182 12/1996 European Pat. Off. .

*Primary Examiner*—Gary Paumen

*Attorney, Agent, or Firm*—Morgan, Lewis & Bockius LLP

[57] ABSTRACT

A male connector connects with a female connector to establish an electrical connection. The male and female connectors each include a connector housing having hold-down tabs at opposite ends thereof for securing the connector housing to a substrate. The hold-down tabs are staggered or diagonally located such that one hold-down tab is proximal a first side of the connector housing and the other hold-down is proximal a second side of the connector housing. The staggered or diagonally-located hold-down tabs stabilize the connector housing against rocking or other movement on the substrate. The arrangement of hold-down tabs also permits the connector housing to nest or merge with another similarly-designed connector housing. The nested or merged connector housing conserve substrate space and permit a higher density of contacts in a given space on the substrate, whether the space is at an edge or in an interior of the substrate. The male and female connector housings include side walls having complementary polarization features. The polarization features on the female connector housing may be formed on a detachable polarization cap. A side of the male connector housing includes a stop member for providing a positive stop for the female connector and to prevent rocking. The stop member is configured to permit side-to-side nesting of male connector housings.

33 Claims, 36 Drawing Sheets

FIG. 23
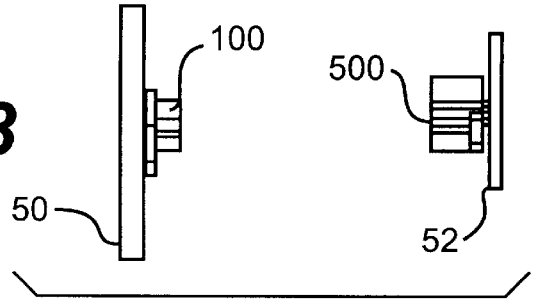
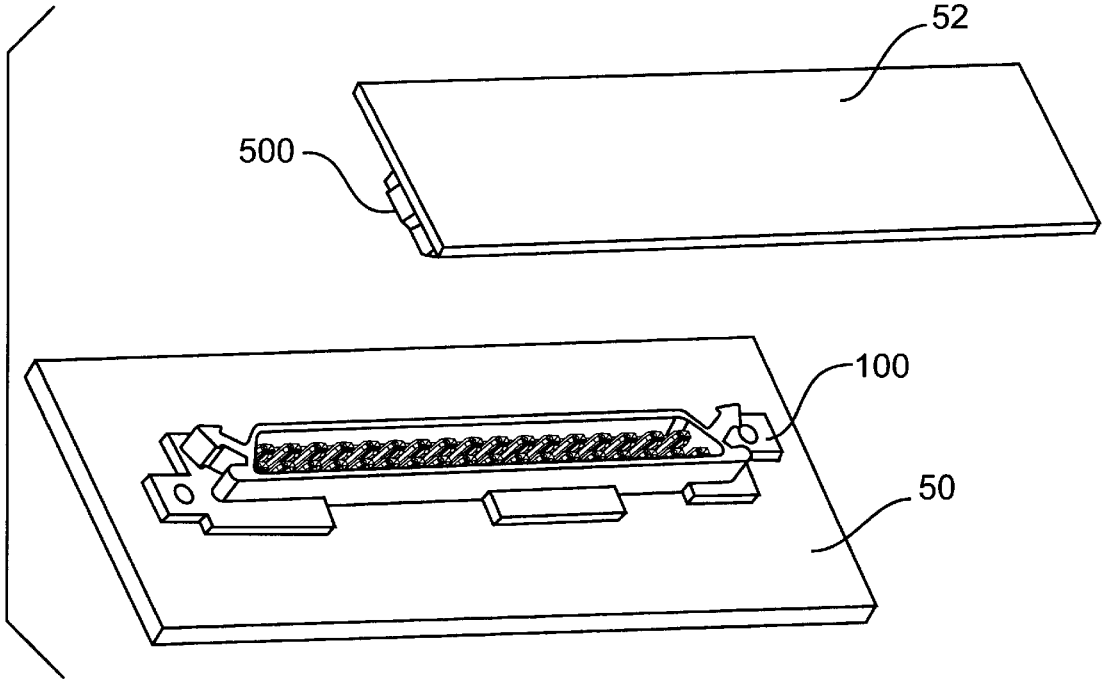
FIG. 24

ELECTRICAL CONNECTOR HAVING STAGGERED HOLD-DOWN TABS

BACKGROUND OF THE INVENTION

This application is related in subject matter to U.S. application Ser. No. 08/911,010, entitled "Electrical Connector Assembly", filed concurrently herewith and expressly incorporated by reference herein.

FIELD OF THE INVENTION

The present invention relates to an electrical connector, and more particularly to an electrical connector that is easily manufactured, mounts stably to a substrate, and provides a high contact density for a given area on the substrate.

DESCRIPTION OF THE PRIOR ART

Conventional electrical connectors include complementary male and female connectors for forming electrical connections between two substrates. An electrical connection is established when the male connector is received by the female connector. For example, computers and other electrical equipment include electrical connectors for connecting printed circuit boards, for connecting a printed circuit board to a backplane, and/or for connecting a printed circuit board to a cable. Electrical connectors may be mounted to a substrate in a vertical orientation or in an edge or right-angle orientation. In the vertical orientation, the electrical connection is established vertically or toward the surface of the substrate. Connectors that mount in an edge or right-angle orientation are often referred to as edge connectors. As the name implies, edge connectors mount to the edge of a substrate and often include contact elements bent in a right angle. Edge connectors establish an electrical connection horizontally or parallel to the substrate surface.

An example of a conventional electrical connector is shown in U.S. Pat. No. 4,274,700 to Keglewitsch et al. FIGS. 1–3 of U.S. Pat. No. 4,274,700 show a vertical female electrical connector having a female connector housing for mounting to a printed circuit board. FIGS. 4 and 5 of U.S. Pat. No. 4,274,700 illustrate a vertical male electrical connector having a male connector housing. As shown in FIGS. 2, 3, and 5 of U.S. Pat. No. 4,274,700, for example, the male and female connector housings each include a pair of fastening flanges extending outwardly from opposite ends of the main housing body. The fastening flanges may include apertures for receiving screws or rivets for securing the housing to the printed circuit board, as shown in FIG. 3. Alternatively, as shown in FIGS. 2 and 5 of U.S. Pat. No. 4,274,700, snap connectors may extend from the bottom surface of the fastening flanges. The snap connectors contract to fit through apertures formed in the printed circuit board and then expand to hold the housing to the printed circuit board. In either case, the apertures or snap connectors are aligned with a longitudinal axis of the connector housing.

Several problems exist with the electrical connector disclosed in U.S. Pat. No. 4,274,700 and similar connectors. For example, stresses applied to the male and female contacts adversely affect the electrical connection between the printed circuit boards. The stresses may cause the male and female contacts to bend, break, or otherwise become misaligned or damaged, whether immediately or in time. The stresses may further damage the electrical connection between the male or female contacts and the printed circuit board to which they are mounted. The problem of stresses on the male and female contacts originates from several sources, a few of which are discussed below. Because the screws, rivets, snap connectors, or other fasteners are aligned with the longitudinal axis of the connector housing, the connector housing tends to rock or pivot on the printed circuit board along the longitudinal axis. In addition, rocking may occur between the male connector housing and the female connector housing during or after mating. Further, as shown in FIG. 7 of U.S. Pat. No. 4,274,700, the male and female contacts support at least a portion of the load of the male connector on the female connector.

While electronic devices have become smaller, the number of connections between printed circuit boards within the electronic devices has increased. Consequently, space on printed circuit boards has become increasingly valuable and should be conserved. Conventional electrical connectors, such as those shown in U.S. Pat. No. 4,274,700, for example, waste space on the printed circuit board.

Conventional edge connectors suffer from the same problems as conventional vertical connectors. FIGS. 1A and 1B illustrate two views of a conventional edge connector 10 fastened to a printed circuit board 20. The edge connector shown in FIGS. 1A and 1B is similar to the edge connector described in U.S. Pat. No. 5,575,688 to Stanford W. Crane, Jr. As shown, conventional edge connector 10 includes a housing 15 mounted to the printed circuit board 20 by screws 16, 17. Similar to the arrangement in U.S. Pat. No. 4,274,700, screws 16, 17 are aligned parallel to the longitudinal axis of edge connector 10. As indicated by the arrow in FIG. 1A, edge connector 10 may rock or pivot with respect to the surface of the printed circuit board 20. While not specifically shown in the drawings, edge connector 10 may also pivot or rock with respect to a corresponding connector. Further, edge connector 10 includes contacts that bear at least some of the connector load when mated. Edge connector 10 also wastes space on the printed circuit board.

Some conventional electrical connectors include fixed polarization features that permit mating in only one orientation. Such fixed polarization features are difficult for a user to identify. As a consequence, the user often attempts to force a connection while the connecters are not properly oriented. When the connection cannot be made, the user re-orients the connectors and tries again to force a connection. The contacts may be damaged when mating is attempted while the connectors are not properly oriented. In addition, such fixed polarization features are not suitable to applications where flexibility is required. Accordingly, there is a need for an improved polarization feature that is more readily identifiable to a user and/or that may be used in a variety of applications. There is also a need to protect the contacts in the event of mismating.

Accordingly, there is a need in the art to provide an electrical connector that is not subject to the deficiencies of conventional electrical connectors.

SUMMARY OF THE INVENTION

The present invention has been made in view of the above circumstances and has as an object to provide an electrical connector that stably mounts to a substrate.

A further object of the present invention is to provide an electrical connector that conserves area on the substrate and achieves a high density of electrical contacts in a given area of the substrate and/or length along the substrate.

A further object of the invention is to provide an electrical connector that provides a positive stop for another connector when mated, so that the contact pins of the electrical connector do not support the load of the other connector.

A further object of the invention is to provide an electrical connector that, when mated with another connector, prevents rocking with respect to that other connector.

A further object of the invention is to provide an electrical connector having a polarization feature that is easily identified by a user and that prevents damage to the contact pins in the event of mismatch.

A further object of the invention is to provide an electrical connector having a polarization feature that is replaceable.

A further object of the invention is to provide an electrical connector that may be easily manufactured with a variable number of contact pins.

A further object of the invention is to provide an electrical connector having any combination of the above objects.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an electrical connector for mounting to a substrate including an insulative connector housing and a plurality of contact pins held in the insulative connector housing. The housing has a first side, a second side opposite the first side, a first end, and a second end opposite the first end. The first and second ends include first and second hold-down tabs, respectively, for mounting the insulative connector housing to a substrate. The first hold-down tab is located proximal the first side and the second hold-down tab is located proximal the second side such that the first and second hold-down tabs are diagonal.

To further achieve the objects and in accordance with the purpose of the invention, as embodied and broadly described herein, the invention further comprises an electrical connector assembly including a male connector and a female connector. The male connector includes a male connector housing and a plurality of male contact pins held in the male connector housing in at least one row. The male connector housing has first and second staggered mounting extensions for mounting the male connector housing to a first substrate. The female connector includes a female connector housing and a plurality of female contact pins held in the female connector housing in at least one row. The female connector housing has first and second staggered mounting extensions for mounting the female connector housing to a side of a second substrate. At least a portion of the male connector is received within the female connector such that the male contact pins contact the female contact pins to establish an electrical connection therebetween.

The present invention further comprises apparatus for permitting mating of first and second electrical connectors in a single orientation embodied by structure including a polarization cap adapted for detachable connection to a face of the first electrical connector. The polarization cap includes one or more polarization features and a plurality of holes configured for receiving electrical contacts of the second electrical connector for contacting electrical contacts of the first electrical connector.

The present invention further comprises an electrical connector for mounting to a substrate and having an insulative mounting element having a first face and a second face, a plurality of contact pins having a contact portion and a tail portion, and a polarization cap detachably connected to said insulative mounting element to cover at least a portion of the first face. The contact pins are held in the insulative mounting element such that the contact portions extend from the first face and the tail portions extend from the second face. The polarization cap has at least one polarization feature and a plurality of openings for permitting access to the contact portions of the contact pins.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiment(s) of the invention and together with the description, serve to explain the principles of the invention.

FIGS. 23, 24, and 25 illustrate a vertical male connector for connecting to a vertical female connector.

DESCRIPTION OF THE PREFERRED EMBODIMENT

Reference will now be made in detail to the present exemplary embodiment(s) of the invention illustrated in the accompanying drawings. Wherever possible, the same reference numbers will be used throughout the drawings to refer to the same or like parts.

Figure 1A:
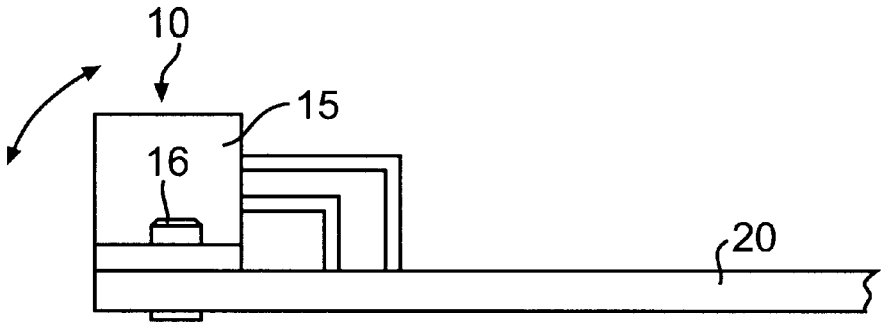
FIG. 1A (PRIOR ART)
FIGS. 1A and 1B illustrate a conventional edge connector fastened to a printed circuit board.
Figure 1B:
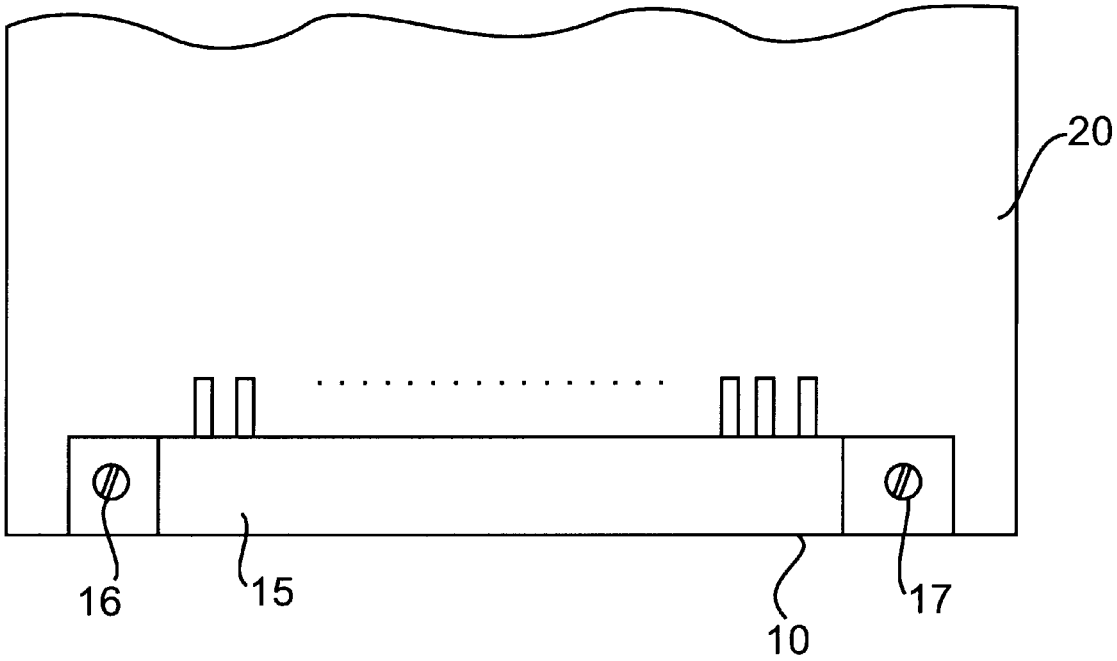
FIG. 1B (PRIOR ART)
Figure 2:
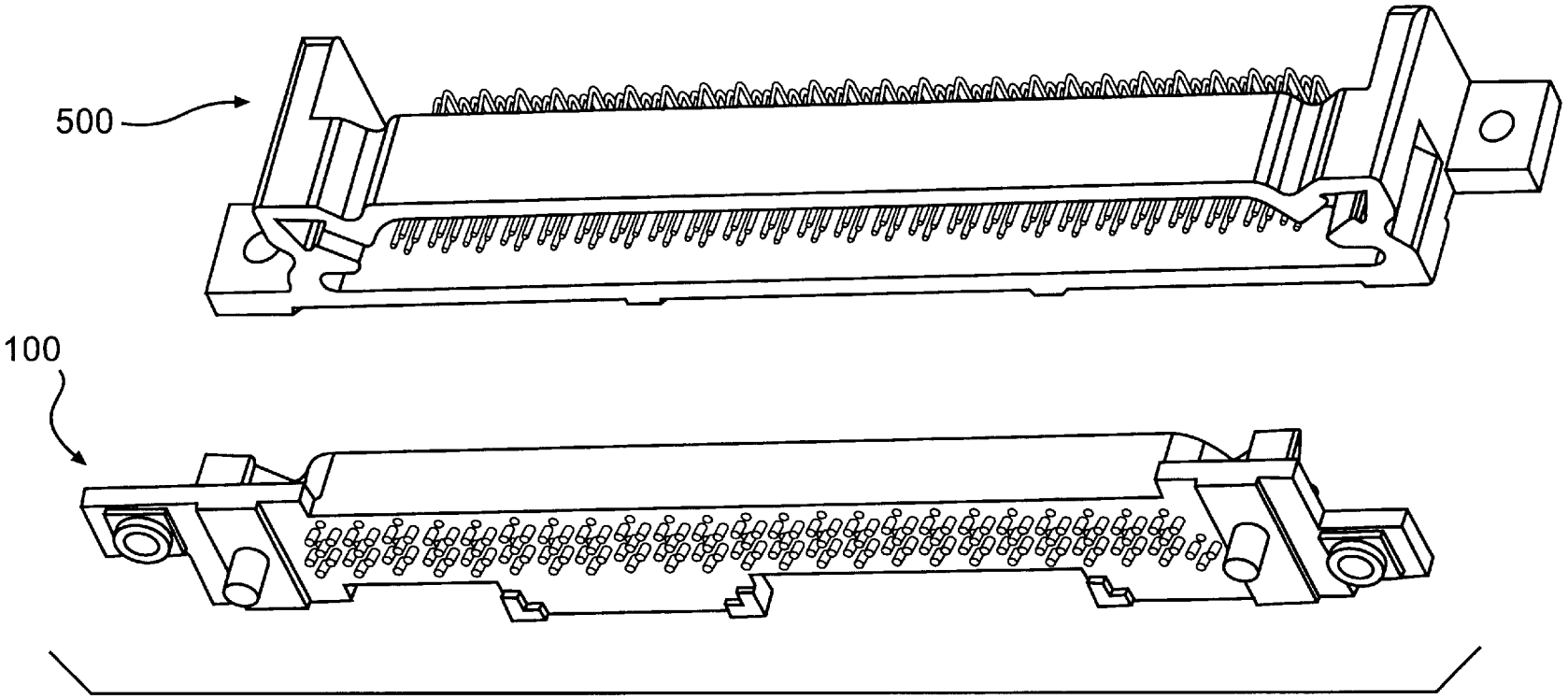
FIGS. 2 and 3 show a male connector and a female connector in accordance with the present invention.
Figure 3:
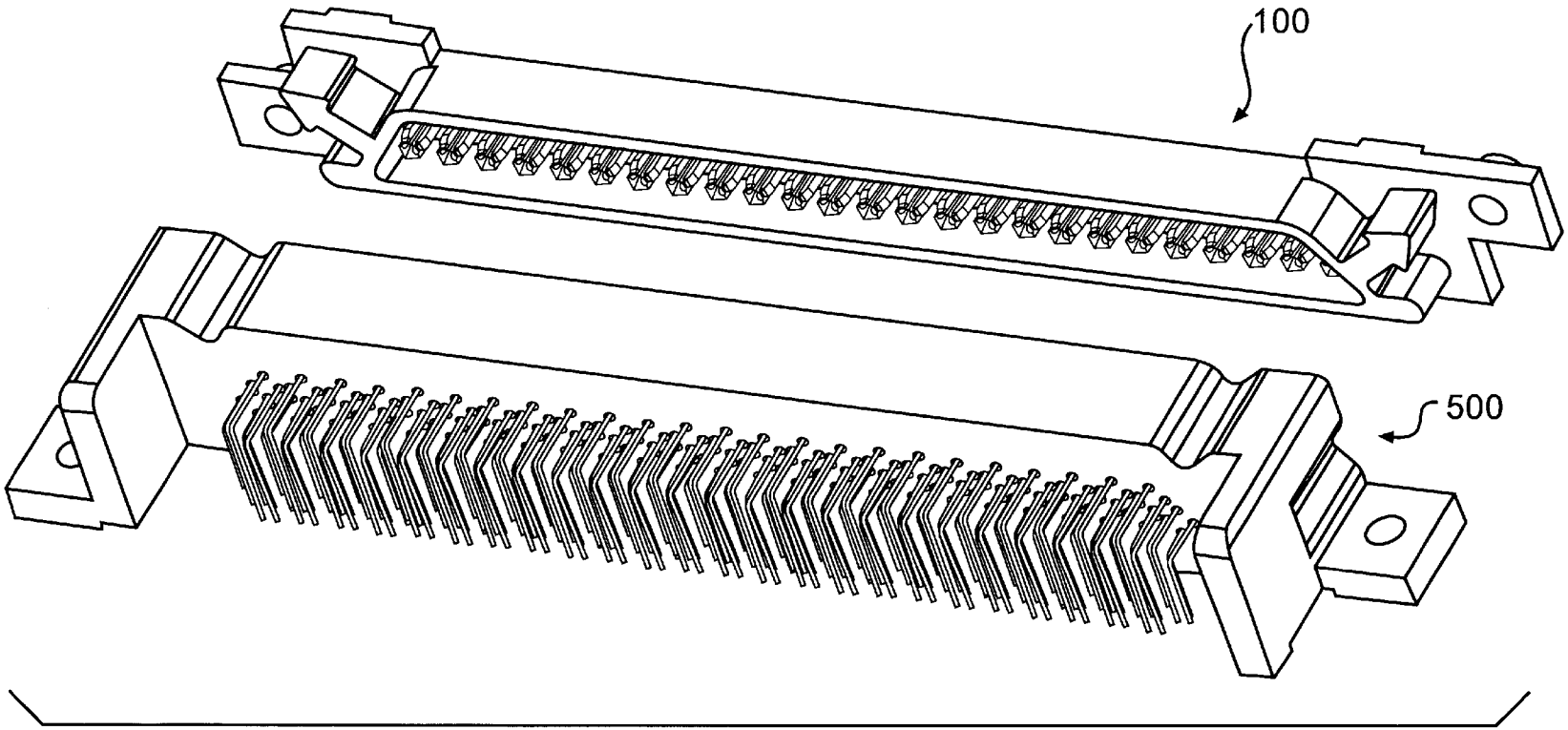

FIGS. 2 and 3 illustrate two views of a male connector 100 and a female connector 500. The male connector 100 may be secured to a substrate, such as a printed circuit board or a backplane mounting, or to a cable, a ribbon cable, a flat flexible cable, or a discrete wire, among other things. Similarly, female connector 500 may be secured to a substrate (not shown). The female connector 500 receives the male connector 100 to establish an electrical connection. Connectors 100, 500 are particularly useful in data communications applications, telephone communication applications, automotive and aircraft applications, and other applications where a high density of electrical contacts is desirable, for example, in an area of a substrate or along the edge of a substrate.

The male connector 100 now will be discussed in greater detail in connection with FIGS. 4–8. The male connector 100 includes a plurality of male contact pins 105 secured in a male connector housing 110. The male connector housing 110 is formed of an insulative material, for example, a polymer or other suitable electrically insulative material. For example, a liquid crystal polymer, such as Hoechst Celanese's VECTRA™, may be used as the insulative material of the male connector housing 110. Of course, the male connector housing 110 may include metallic shielding against noise or other interference. For example, side wall 120 of the male connector housing may include a metallic insert, such as a metallic strip or series of strips, which may be molded into the side wall material. Alternatively, a separate shielding sleeve or shroud (not shown) may fit over the male or female connectors, or over the mated male and female connectors.

Figure 4A:
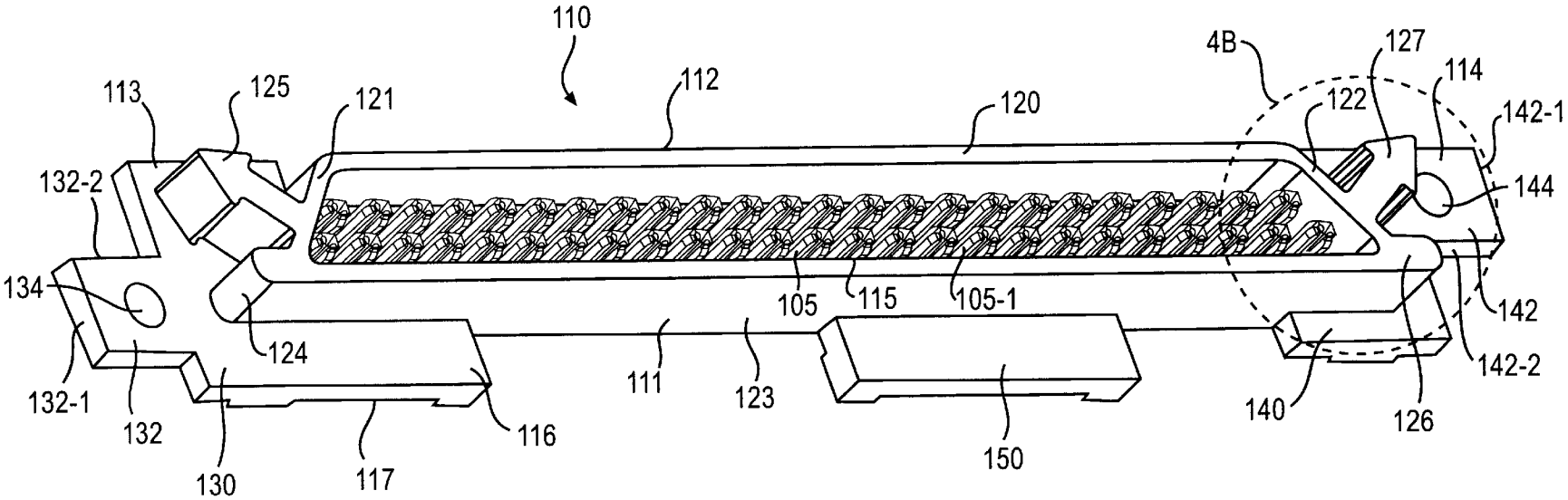
FIGS. 4A, 4B, 5, 6, 7, and 8 illustrate various views of the male connector according to the present invention.
Figure 4B:
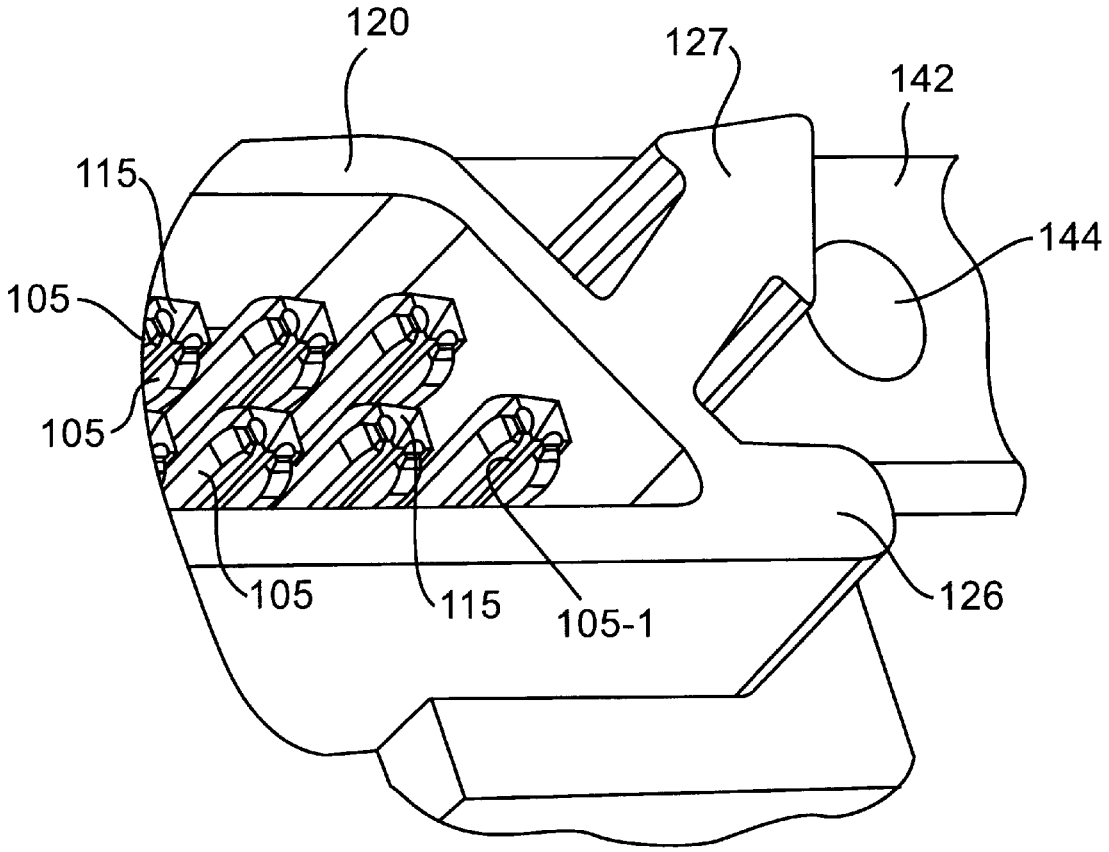

The male connector housing includes a first side 111, a second side 112, a first end 113, a second end 114, a top face 116, and a bottom face 117. As shown in FIGS. 4A and 4B, for example, the male pins 105 are arranged in clusters around a plurality of buttresses 115 extending from the top face 116. The buttresses 115 may be arranged in an array on the top face 116. As shown in FIG. 4B, for example, the buttresses 115 have a generally rectangular cross section. Clusters of four male pins 105-1 are arranged on the sides of the buttresses 115. However, other arrangements are possible consistent with the present invention. For example, buttresses 115 may have a different shape or may be omitted entirely, and the male pins 105 may be arranged in clusters of one or more. As shown, the male pins 105 are arranged in rows and the clusters of male pins 105-1 are arranged in rows.

By way of example, the buttresses 115 may be provided with different heights in order to reduce insertion force. In addition, the buttresses 115 may be staggered and/or nested such that the contact surface of the male pin in one cluster faces the side surface of a male pin in another cluster. In this regard, reference may be made to U.S. Pat. No. 5,641,309 to Stanford W. Crane, Jr.

As shown in FIG. 4A, a side wall 120 may be provided on the top face 116 of the male connector housing 110 to continuously surround buttresses 115. The height of the side wall 120 is preferably greater than the heights of buttresses 115 and male pins 105, for example. The side wall 120 serves, among other things, to protect the male pins 105 and the buttresses 115 before, during, and after mating and in the event of mismatch. Of course, it is not necessary for the side wall 120 to continuously surround the buttresses 115 in order to protect the male pins 105 and buttresses 115. An interior surface of side wall 120 may be formed with a slight angle, one degree, for example, to facilitate removal from a mold during manufacture.

The side wall 120 may include polarization features to prevent a mismatch between the male connector 100 and female connector 500. For example, a rounded projection 124 and an arrow-shaped projection 125 may project from a top face 116 of the male connector housing. As shown in FIG. 4A, for example, both the rounded projection 124 and the arrow-shaped projection 125 may extend from or be merged with an end 121 of side wall 120. The top face 116 of male connector housing may also include a rounded projection 126 and an arrow-shaped projection 127. The rounded projection 126 and the arrow-shaped projection 127 may extend from or be merged with an end 122 of side wall 120. As shown in FIG. 4A and elsewhere, arrow-shaped projection 125 generally points diagonally toward side 112 and end 113 of the male connector housing 110 and arrow-shaped projection 127 generally points diagonally toward side 112 and end 114 of the male connector housing 110. Of course, the arrow-shaped projections 125, 127 may point in other directions, for example, toward side 111, instead of side 112, or one arrow-shaped projection may point generally toward side 112 and the other may point generally toward side 111. Other asymmetrical arrangements may be formed to ensure that mating between the male connector 100 and the female connector 500 may occur in only one orientation.

Rounded projections 124, 126 and arrow-shaped projections 125, 127 serve as guides to proper mating of the male and female connectors. Arrow-shaped projections 125, 127, in particular, are visually distinct and are quickly and easily seen by a user and thereby enable the user to identify the proper orientation of the male connector 100 with respect to the female connector 500 for mating. Of course, the projections may have another easily-identifiable geometric shape, such as a circle, diamond, cross, star, square, a number, among others, or may have a combination of geometric shapes, sizes, and/or orientations. Alternatively, only one of any of the polarization and/or keying features may be provided.

In addition to facilitating proper mating, rounded projections 124, 126 and arrow-shaped projections 125, 127 prevent mating at an improper angle, at an offset, or both. Moreover, the rounded projections 124, 126 and arrow-shaped projections 125, 127, in combination with side wall 120, prevent the female connector 500 from damaging the male pins 105 in the event of mismatch.

The male connector housing 110 further includes a plate 130 at the first end 113 of male connector housing 110, a plate 140 at the second end 114 of the male connector housing 110, and a stop plate 150 disposed at an exterior side surface 123 of side wall 120. Plate 130 includes a hold-down tab or extension 132 having an end 132-1, a side 132-2, and an aperture 134. Similarly, plate 140 includes a hold-down tab or extension 142 having an end 142-1, a side 142-2, and an aperture 144. The hold-down tab may be a flange, seat, bracket, plate, annulus, or other mounting feature or surface for securing a connector housing to a substrate.

Hold-down tabs 132, 142 serve to mount the male connector housing 110 to a substrate. For example, apertures 134, 144 may receive screws, rivets, or other fasteners to secure the male connector housing 110 to a printed circuit board or other substrate. Of course, consistent with the present invention, the apertures 134, 144 may be replaced by snap connectors or other fastening devices for connecting or facilitating connection of the male connector housing 110 to a printed circuit board or other substrate.

Hold-down tabs 132, 142 are diagonally disposed, staggered, or offset with respect to the male connector housing 110. In this regard, hold-down tab 132 is disposed proximal the first side 111 and distal the second side 112, and hold-down tab 142 is disposed proximal the second side 112 and distal the first side 111. More particularly, a line connecting a center of aperture 134 and a center of aperture 144 crosses the longitudinal axis of the male connector housing 110 and is diagonal to the rows of male pins 105 and rows of male pin clusters. The diagonally disposed hold-down tabs 132, 142 enable the male connector housing 110 to be stably secured to the printed circuit board or other substrate without rocking or other movement.

Figure 5:
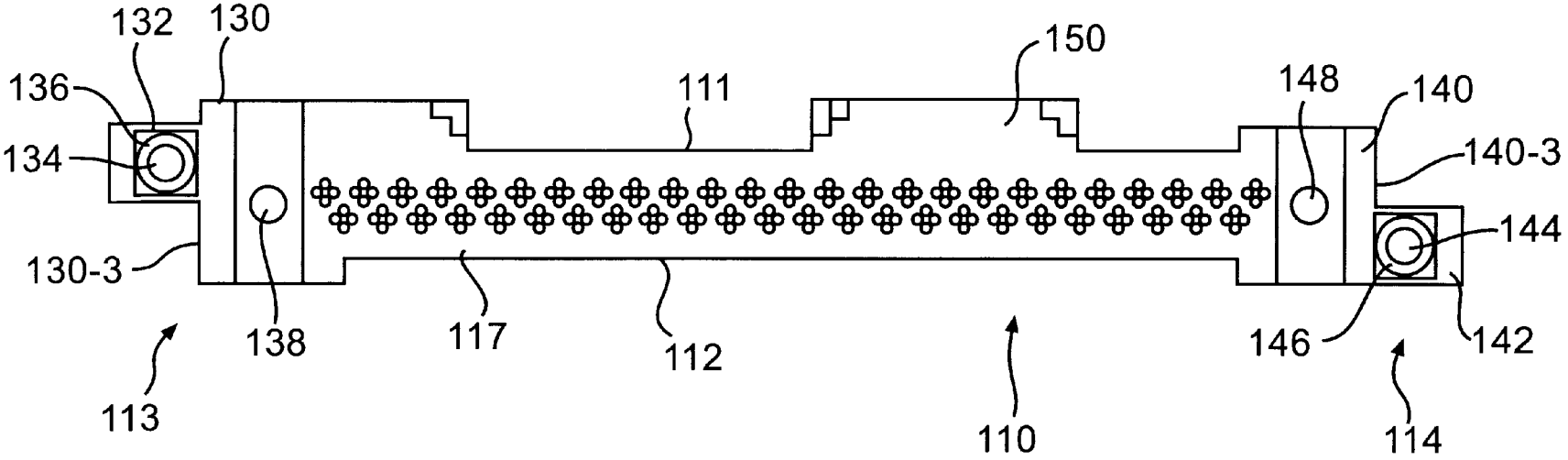

Further, as shown in FIG. 5 and as discussed further below, hold-down tabs 132, 142 may be complementary to permit nesting or merging with other male connectors 100. In particular, hold-down tab 132 of a first male connector fits against a hold-down tab 142 of a second male connector so that end 132-1 of the first male connector abuts an end 140-3 of the second male connector's plate 140, side 132-2 of the first male connector abuts side 142-2 of the second male connector, and end 130-3 of the first male connector's plate abuts end 142-1 of the second male connector. When fit together, the rows of male pins 105 or male pin clusters 105-1 of both connectors are aligned. Similarly, hold-down tab 142 of the first male connector fits with a hold-down tab 132 of a third male connector 100 so that end 142-1 of the first male connector abuts an end 130-3 of the third male connector's plate 140, side 142-2 of the first male connector abuts side 132-2 of the third male connector, and end 140-3 of the first male connector's plate abuts end 132-1 of the third male connector. The male pins 105 of both connectors are aligned when their connector housings are fit together. While FIG. 7, for example, shows ends 132-1, 132-2, sides 142-1, 142-2, and ends 130-3, 140-3 to be rectilinear, any complementary form may be used consistent with the present invention.

Figure 6:
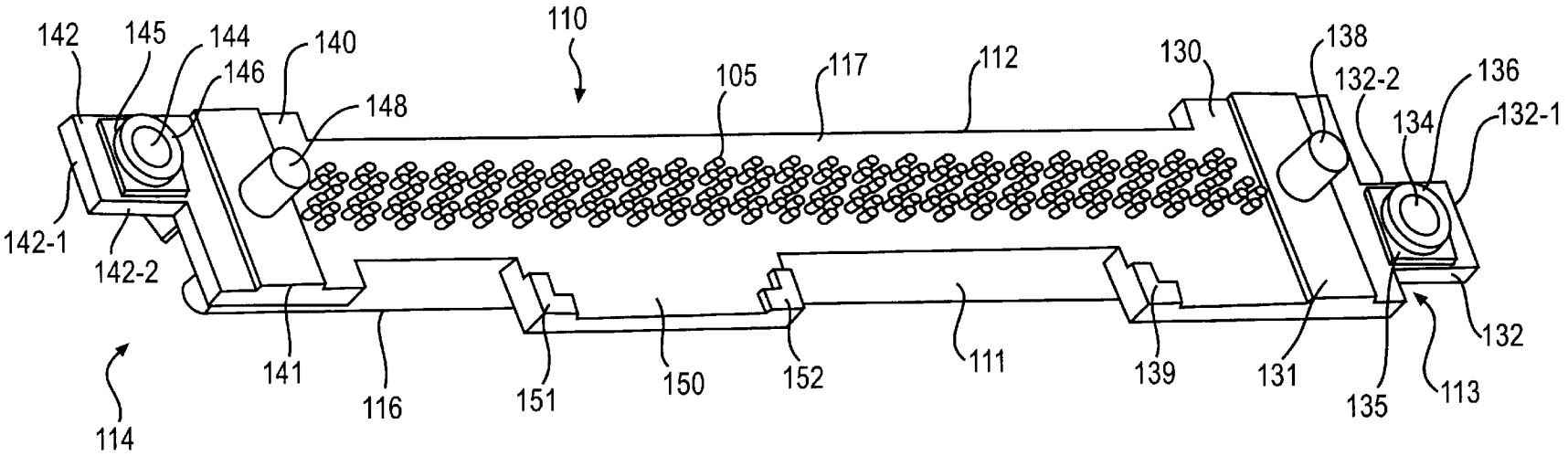

FIGS. 5 and 6 illustrate the bottom face 117 of male connector 100. The bottom face 117 includes a generally flat surface having elevated stand-offs 131, 135, 139, 141, 145, 151, and 152. The stand-offs provide a mounting surface for the male connector housing 110 for mounting to the surface of the printed circuit board or other substrate. The stand-offs balance the male connector housing 110 on the substrate, yet permit air flow between the bottom face 117 of the connector housing 110 and the printed circuit board or other substrate.

Stand-offs 135, 145 extend from hold-down tabs 132, 142, respectively. Stand-offs 135, 145 may include guide sleeves 136, 146 at aperture 134, 144 for seating within apertures formed in the substrate to accurately position the male connector housing 110. Similarly, posts 138, 148 may extend from stand-offs 131, 141, respectively, for further positioning the male connector 110 and guiding it into the substrate.

Figure 7:
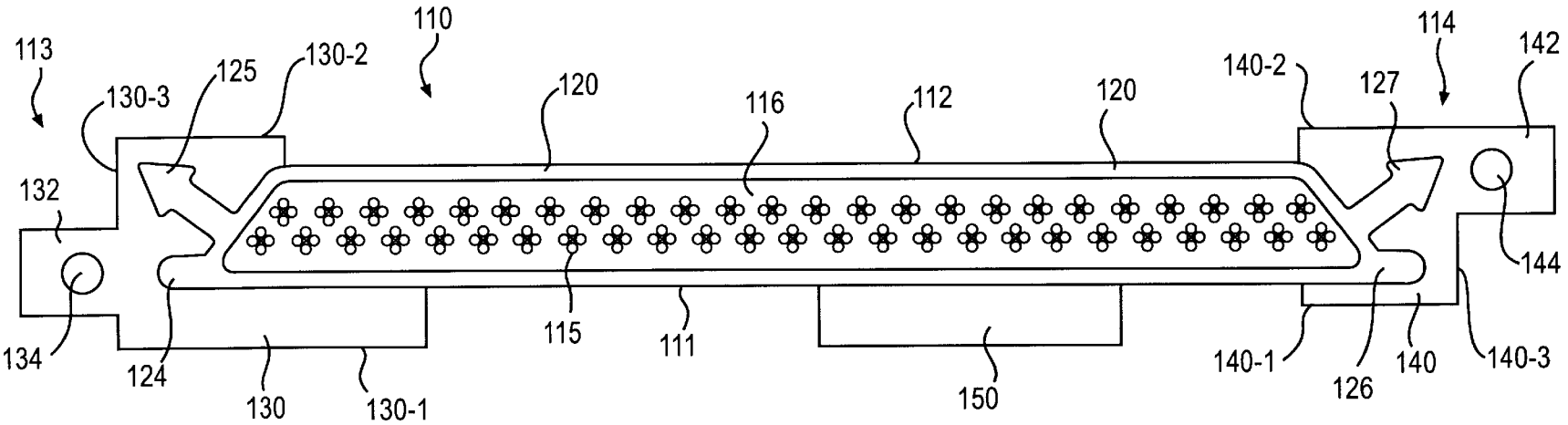

FIG. 7 illustrates the top face 116 of the male connector housing 110 prior to insertion of the male pins 105. Plates 130, 140 includes side edge portions 130-1, 140-1 and side edge portions 130-2, 140-2. Side edge portions 130-2 and 140-2 extend an equal distance in a lateral direction away from side wall 120. Side edge portion 130-1 extends along side wall 120 for a distance, but terminates before reaching stop plate 150, leaving a first gap. The first gap is at least as wide as stop plate 150, for reasons discussed further below. Side edge portion 130-1 and stop plate 150 extend laterally away from side wall 120 for a distance sufficient to ensure that a substrate, such as a printed circuit board, will abut the side edge portion 130-1 and the stop plate 150 when the male connector is mated with a female connector. In one preferred embodiment, the side edge portion 130-1 and the stop plate 150 extend an equal distance laterally from the side wall 120.

Side edge portion 140-1 extends laterally away from side wall 120 a distance substantially less than that of side edge portion 130-1 and stop plate 150. However, this is not required for purposes of the present invention.

Stop plate 150 and side edge portion 130-1 together provide a positive stop for the female connector 500 during mating and support the female connector 500 after mating. Therefore, the load of female connector 500 on the male connector 100, both during and after mating, is not supported by the male or female pins. Rather, the load from the female connector is supported by the male connector housing 110, specifically the stop plate 150 and the side edge portion 130-1. Further, the positive stop prevents the male and female pins and/or the buttresses from bottoming out against another structure. In addition, the stop plate 150 and side edge portion 130-1 support the printed circuit board or other substrate to which the female connector 500 is attached to prevent rocking and to maintain stability.

Of course, an edge portion 130-1 and stop plate 150 are not both required. For example, a single stop plate 150 may be made longer to prevent rocking and to support the substrate and the female connector by itself, or multiple stop plates 150 may be provided. Alternatively, side edge portion 130-1 alone may be adapted for stabilizing and supporting the female connector. Further, it is preferable, but not necessary, that side 111 of the male connector housing 110 includes projections (e.g., edge portion 130-1 and/or stop plate 150) and indents (e.g., the gap between edge portion 130-1 and stop plate 150) to permit the sides 111 of two male connector housings to fit together. As discussed below, it is not necessary for the projections to fit snugly in the indents when the sides of two male housings are fit together. The projections may fit loosely in the indents consistent with the present invention.

Figure 8:
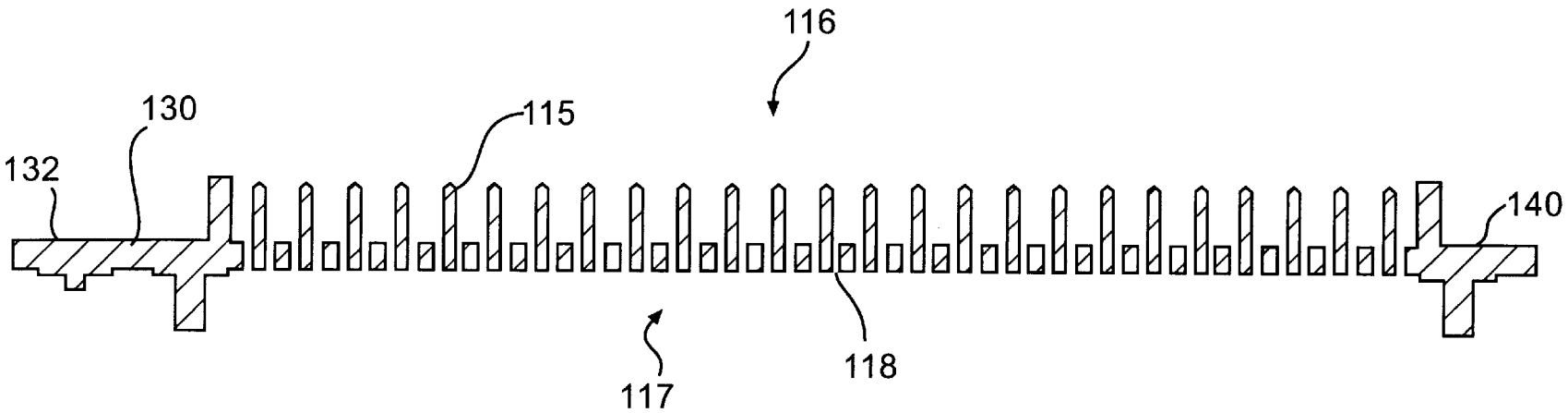

FIG. 8 illustrates a cross section of the male connector housing 110. As shown, the holes 118 pass entirely through the male connector housing. Holes 118 receive and retain the male pins 105. FIG. 8 also shows that the height of the side wall 120 may be greater than the height of the buttresses 115.

Figure 9A:
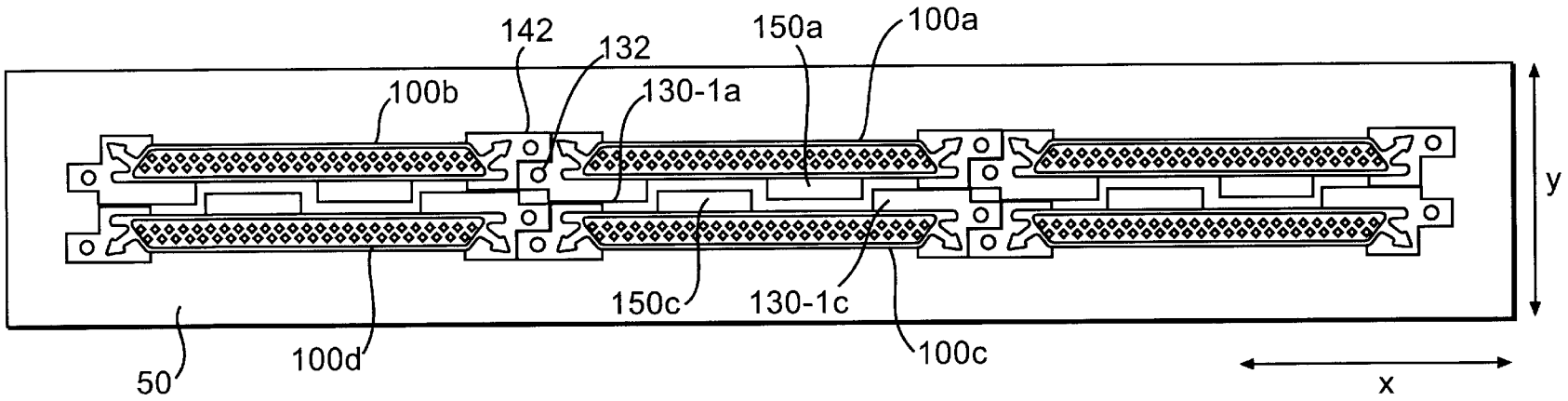
FIGS. 9A, 9B, and 9C illustrate a series of interlocking, vertical male connectors mounted to a printed circuit board.
Figure 9B:
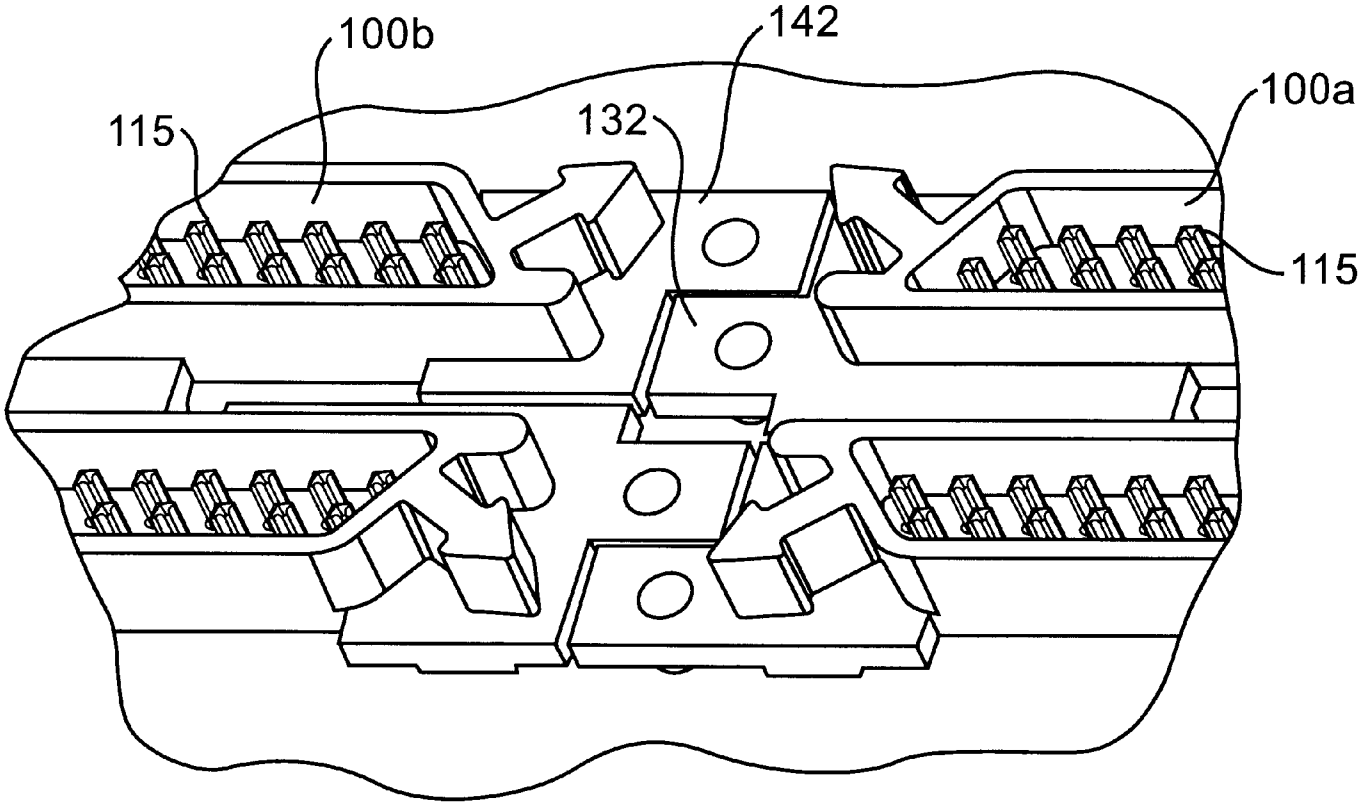
Figure 9C:
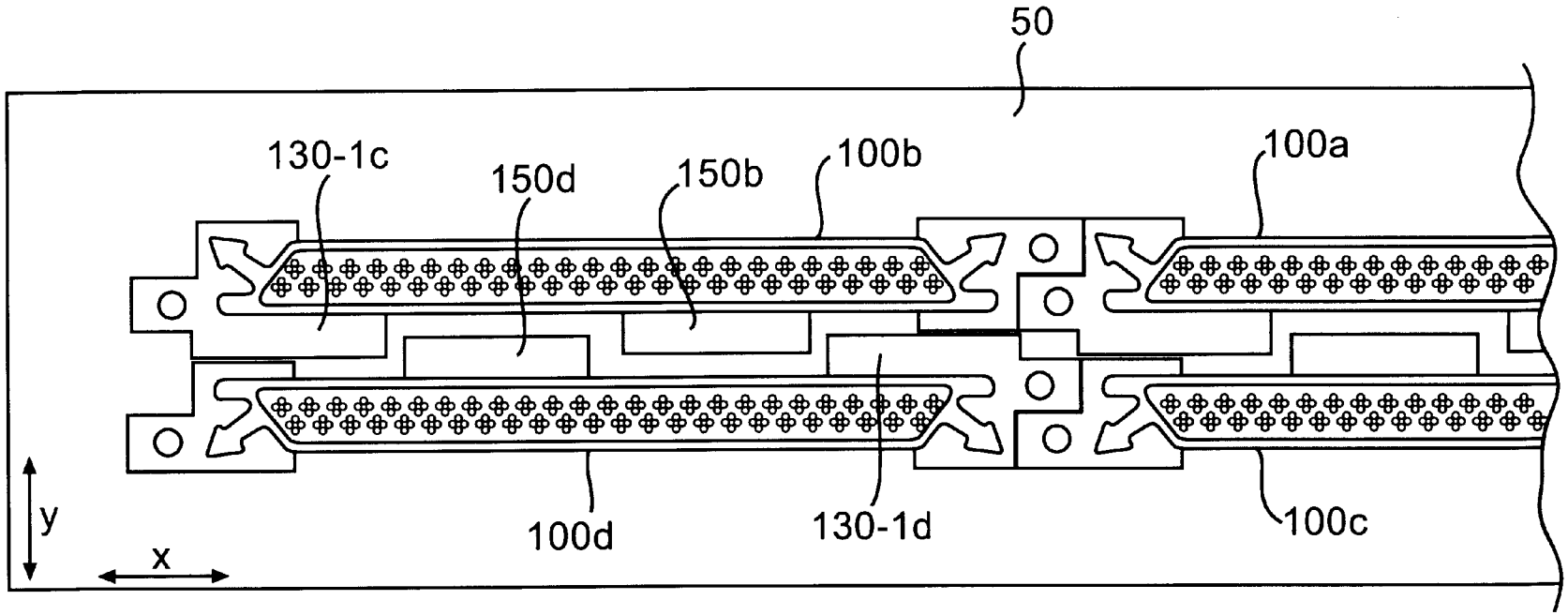

FIG. 9A illustrates two rows of three male connectors 100 each mounted to a printed circuit board 50. As shown, the male connectors 100 are nested in both x and y directions to increase the density of contacts that may be provided in a given area of the substrate. FIGS. 9A and 9B illustrate the nesting in the x direction or end-to-end nesting. For example, hold-down tab 132 of male connector 100*a* nests or merges with hold-down tab 142 of male connector 100*b* such that the rows of male pins 105 and rows of male pin clusters 105-1 of male connector 100*a* align with the rows of male pins 105 and rows of male pin clusters of male connector 100*b*. Moreover, male connector 100*a* also nests with male connector 100*c*. As shown in greater detail in FIG. 9C using male connectors 100*b* and 100*d* as examples, male connector 100*b* nests with male connector 100*d* in the y-direction, or side-to-side. The stop plate 150*b* of male connector 100*b* fits in the gap between stop plate 150*d* and side portion 130-1*d* of male connector 100*d*. While stop plate 150*b* may fit snugly in the gap, this is not necessary for purposes of the present invention. As shown in FIG. 9C, stop plate 150*b* may fit loosely in the gap. Likewise, stop plate 100*d* of male connector 100*d* fits in the gap between stop plate 150*b* and side portion 130-1*b* of male connector 100*b*. Of course, additional connectors and/or an additional single row or double row of male connectors 100 may be positioned at the ends or on either side of the double row of male connectors 100 shown in FIG. 9A.

Figure 10:
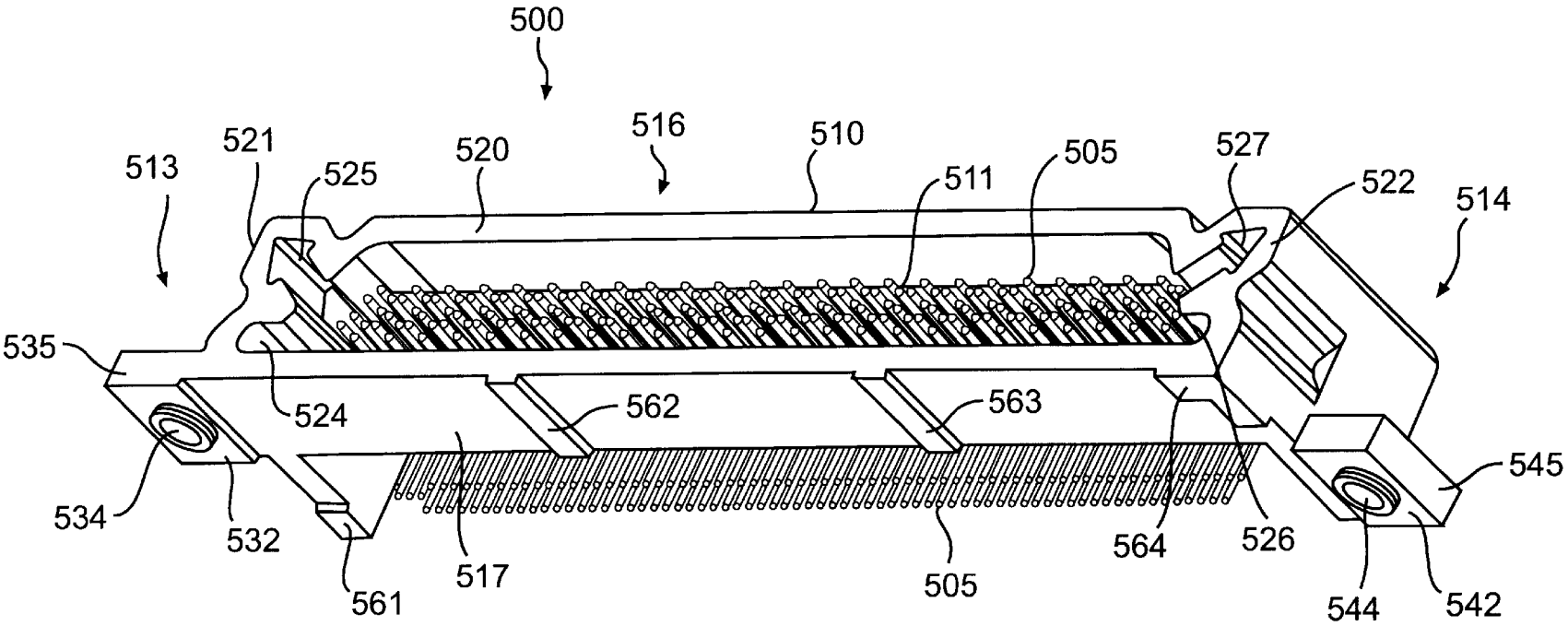
FIGS. 10, 11, 12, 13, and 14 illustrate various views of the female connector in accordance with the present invention.

The female connector 500 will be described in connection with FIGS. 10–13. As shown in FIG. 10, the female connector 500 is embodied as an edge or right-angle connector and includes a plurality of female contact pins 505 secured in a female connector housing 510. The female connector housing 510 is formed of an insulative material, for example, a polymer or other suitable electrically insulative material. For example, a liquid crystal polymer, such as Hoechst Celanese's VECTRA™, may be used as the material for the female connector housing 510. Of course, the female connector housing 510 may include metallic shielding against noise or other interference. In this regard, a metallic strip or series of strips may be molded into side wall 520. Alternatively, a shielding sleeve or shroud (not shown) may be fitted over the female connector housing 510. The shielding sleeve or shroud may be made entirely of metal or may include insulation.

Figure 11:
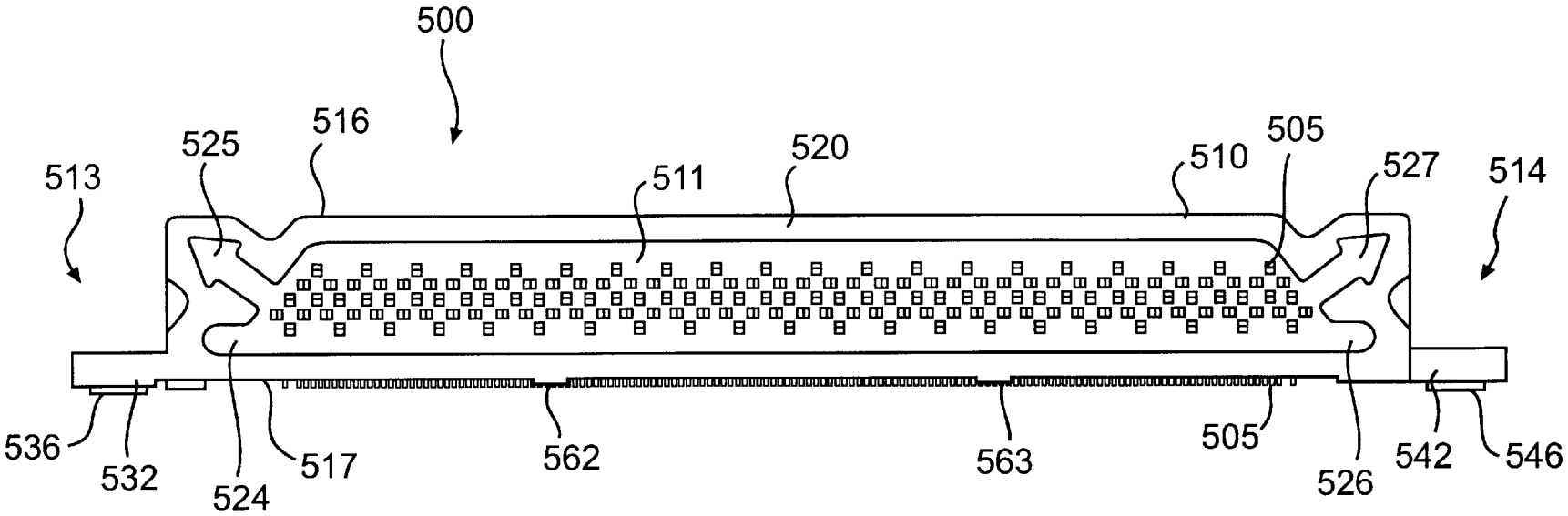

The female connector housing 510 includes a front face 511, a back face 512, a first end 513, a second end 514, a top 516, and a bottom 517. The arrangement of female pins 505 corresponds to the arrangement of male pins 105 in the male connector 100. As shown in FIGS. 10 and 11, for example, the female pins 505 are arranged in multiple rows. The female pins 505 form clusters of four extending from the front face 511 and the clusters form multiple rows. Each cluster of female pins 505 receives a corresponding cluster of male pins 105 and its buttress 115 when the female connector 500 and the male connector 100 are mated. Other arrangements of female pins 505 similar to those of the male pins 105 (e.g., a different number of female pins per cluster or a different arrangement of clusters) noted above are possible consistent with the present invention.

As shown in FIG. 10, a side wall 520 may be provided on the front face 511 of the female connector housing 510 to protect the female pins 505 before, during, and after mating and in the event of mismatch. For example, the side wall 520, including end 513 and end 514, prevents the male connector 100 from damaging the female pins 505 during mismatch. The side wall 520 may continuously surround the female pins 505 as shown in FIG. 10 or may partially enclose the female pins 505. The height of the side wall 520 is preferably greater than the height of female pins 505. An interior surface of side wall 520 may be formed with a slight angle, one degree, for example, to facilitate removal from a mold during manufacture.

Side wall 520 may include polarization and/or keying features complementary to the polarization and/or keying features provided on the male connector housing 110. For example, end 521 of side wall 520 defines a rounded space or void 524 and an arrow-shaped space of void 525, and end 522 of side wall 520 defines a rounded space or void 526 and an arrow-shaped space or void 527. As shown in FIG. 10 and elsewhere, arrow-shaped space 525 generally points diagonally toward top 516 and end 513 of the female connector housing 510. Arrow-shaped space 527 generally points diagonally toward top 516 and end 514 of the female connector housing 510. Of course, the polarization features may point toward bottom 517 or embody some other asymmetrical arrangement to ensure that mating between the male connector 100 and the female connector 500 may occur in only one orientation.

Side wall 520, including rounded spaces 524, 526 and arrow-shaped spaces 525, 527, receive side wall 120 of the male connector housing 110, its rounded projections 124, 126, and its arrow-shaped projections 125, 127. The combination of these features serves to guide the male and female connectors into proper alignment for mating and to prevent mating at an improper angle, at an offset, or both. The arrow-shaped spaces 525, 527 enable a user to quickly and easily identify the proper orientation of the female connector 500 for mating. Of course, one or more of ends 513, 514 may define another identifiable geometric shape, such as a circle, diamond, cross, star, square, or number, among others, or may have a combination of geometric shapes, different sizes, and or different orientations.

As shown in FIG. 11, among others, the female connector housing 510 further includes a hold-down tab 532 at first end 513 and a hold-down tab 542 at second end 514. Hold-down tabs 532, 542 serve to mount the female connector housing 510 to the substrate. For example, the hold-down tabs 532, 542 may include apertures 534, 544, respectively, for receiving screws, rivets, or other fasteners to secure the female connector housing 510 to a printed circuit board or other substrate. Apertures 534, 544 may be replaced by snap connectors or other fastening devices for connecting or facilitating connection of the female connector housing 510 to a printed circuit board or other substrate.

Hold-down tab 532 is disposed proximal the front face 511 and hold-down tab 542 is disposed proximal the back face 512. Thus, hold-down tabs 532, 542 are diagonally disposed, staggered, or offset with respect to the female connector housing 510. More particularly, a line connecting a center of aperture 534 and a center of aperture 544 crosses the longitudinal axis of the female connector housing 510 and is diagonal to the rows of female pins 505 and the rows of female pin clusters. The diagonally disposed hold-down tabs 532, 542 provide a foundation for stably securing the female connector housing 510 to the printed circuit board or other substrate without rocking or other movement.

Similar to the hold-down tabs on the male connector housing 110, hold-down tabs 532, 542 of the female connector housing 510 may be complementary to permit nesting or merging with other female connector housings 510. Hold-down tab 532 of a first female connector fits against a hold-down tab 542 of a second female connector so that end 532-1 of the first female connector abuts an end 514-1 of the second female connector housing 510, side 532-2 of the first female connector abuts side 542-2 of the second female connector, and end 513-1 of the first female connector housing abuts end 542-1 of the second female connector. When fit together, the female pins 505 of both connectors are aligned. Similarly, hold-down tab 542 of the first female connector fits together with a hold-down tab 532 of a third female connector 100 so that end 542-1 of the first female connector abuts an end 513-1 of the third female connector housing, side 542-2 of the first female connector abuts side 532-2 of the third female connector, and end 514-1 of the first female connector housing abuts end 532-1 of the third female connector. The female pins 505 of both connectors are aligned when their connector housings are fit together. While FIG. 13, for example, shows ends 532-1, 532-2, sides 542-1, 542-2, and ends 513-1, 514-1 to be rectilinear, any form that is complementary or that produces a fixed relationship between two connectors may be used consistent with the present invention.

Figure 12:
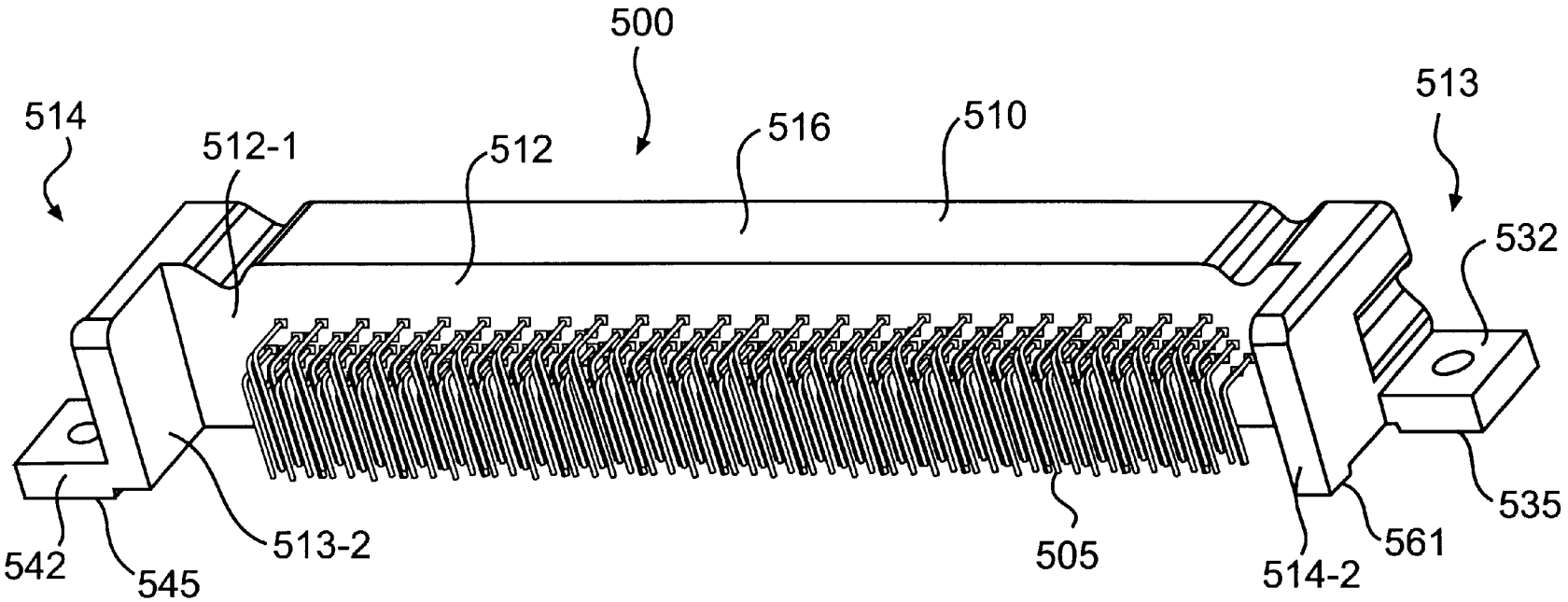
Figure 13:
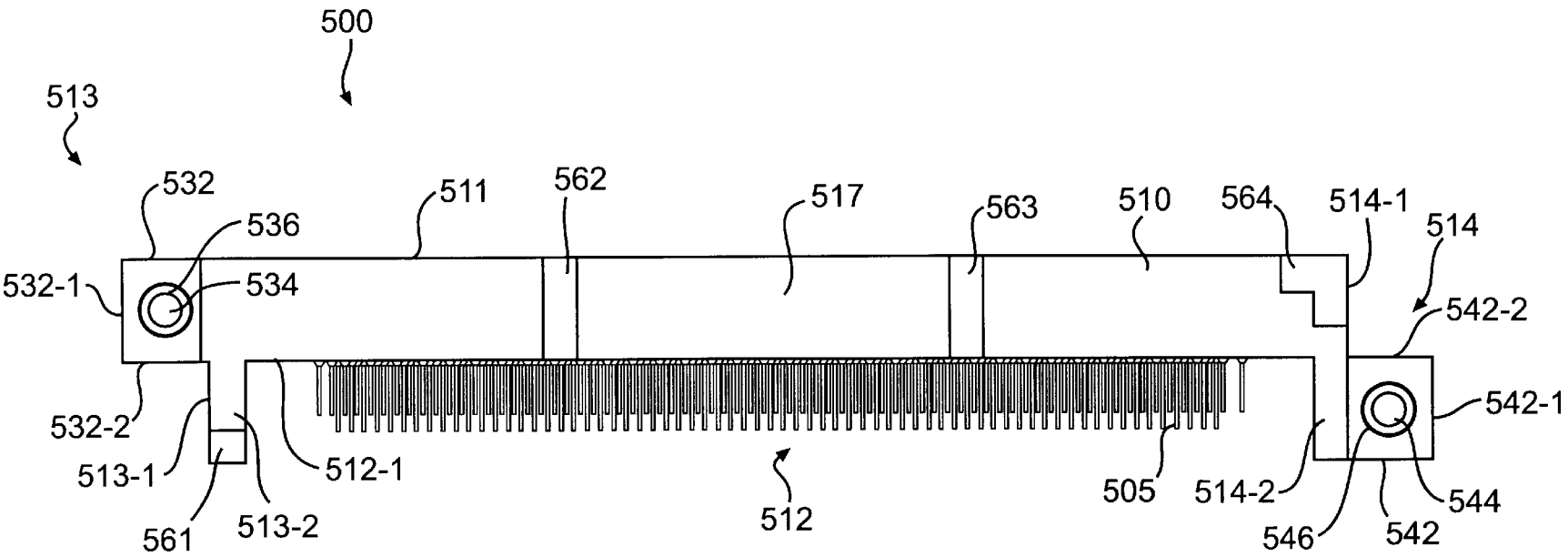

FIGS. 12 and 13 illustrate the back face 512 and bottom 517 of the female connector 500. Female pins 505 exit the female connector housing 510 at back surface 512-1 and then extend down, e.g., at a right angle, to the substrate (not shown). Ends 513, 514 include end supports 513-2, 514-2 extending from the back surface 512-1. As shown in FIG. 12, for example, hold-down tab 542 extends from end support 514-1 yet provides clearance for assembly.

The bottom 517 includes a generally flat surface having elevated stand-offs 535, 545, 561, 562, 563, and 564. The stand-offs balance the female connector housing 510 on the surface of the printed circuit board or other substrate and permit air flow between the bottom 517 and the printed circuit board or other substrate.

Stand-offs 535, 545 extend from hold-down tabs 532, 542, respectively. Stand-offs 535, 545 may include guide sleeves 536, 546 at apertures 534, 544, respectively, for seating within apertures formed in the substrate to accurately position the female connector housing 510. The female connector housing 510 may further include posts (not shown) extending from the bottom surface for further positioning the female connector housing 510 and guiding it into the substrate.

Figure 14:
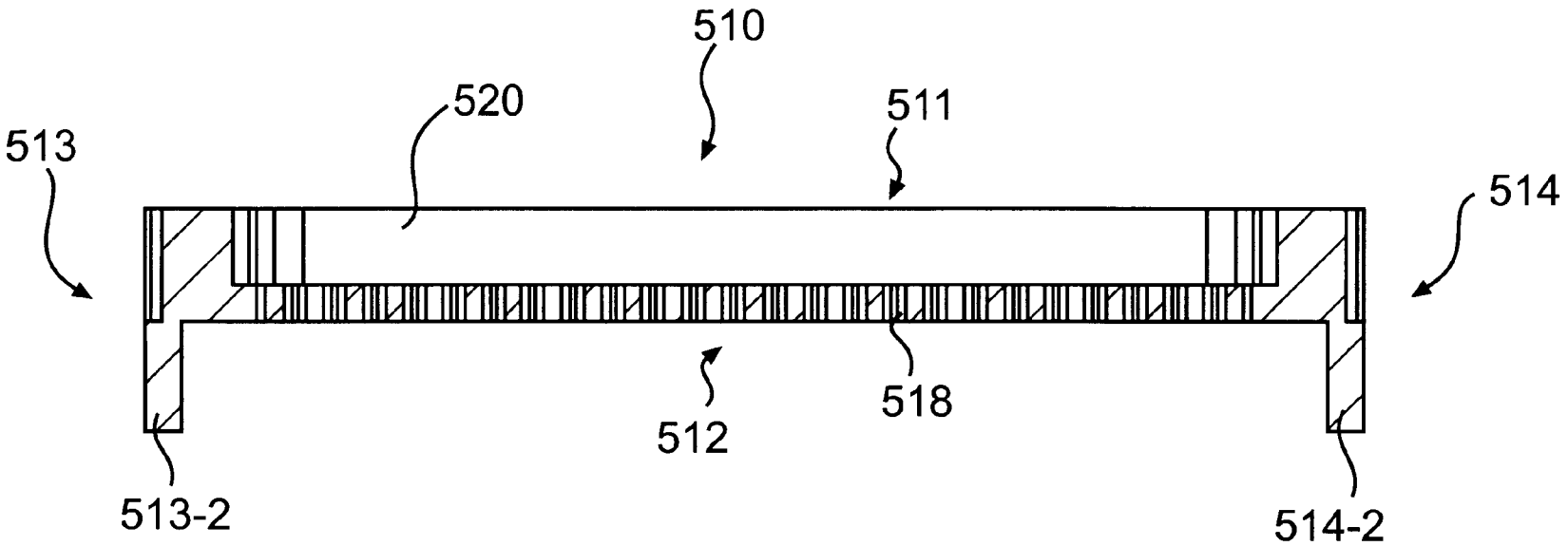

FIG. 14 illustrates a cross section of the female connector housing 510. As shown, the holes 518 extend through the female connector housing 510. The holes 518 receive and retain the female pins 505.

Figure 15A:
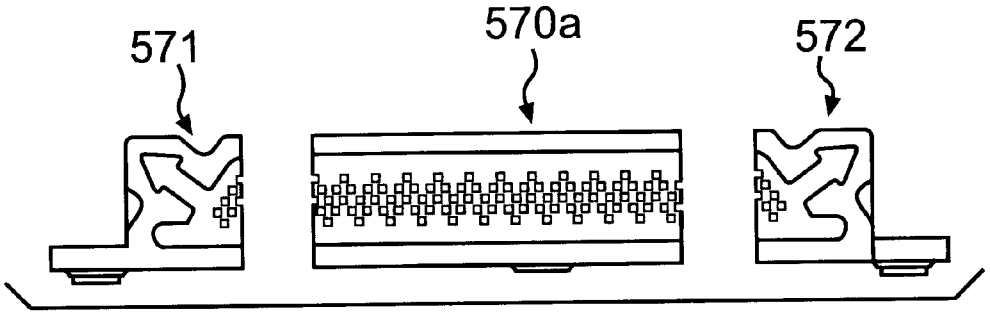
FIGS. 15A and 15B illustrate an embodiment of a modular design of the female connector housing for manufacturing with a varying number of female pins.
Figure 15B:
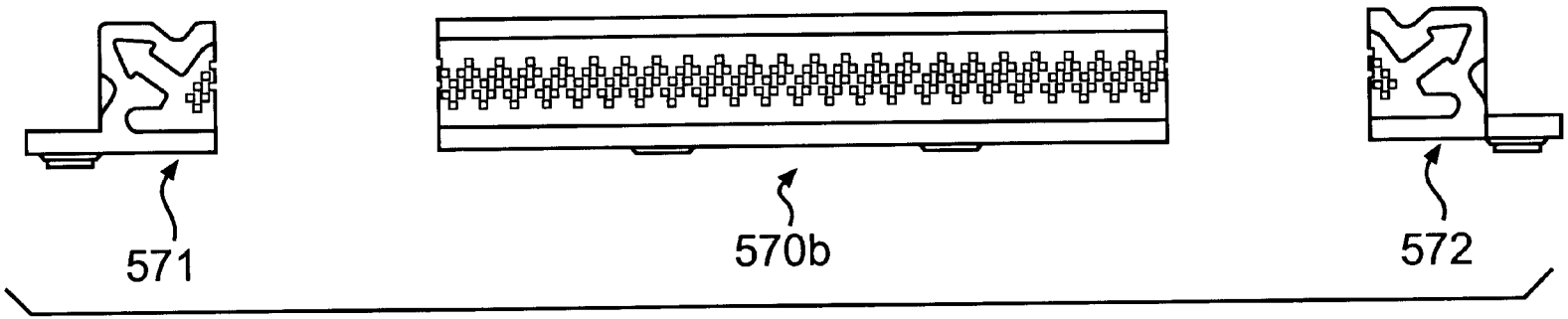

FIGS. 15A and 15B illustrate a modular design for manufacturing female connector housings with a varying number of female pins 505. As shown in FIG. 15A, end pieces 571, 572 connect to opposite ends of center piece 570*a* to form female connector housing 510 for supporting a given number of female pins 505. Alternatively, FIG. 15B shows that end pieces 571, 572 may be connected to center piece 570*b* to form a female connector housing 510. Center piece 570*a* has a shorter length than center piece 570*b* and supports fewer female pins 505. Different center pieces may be selected based on connector length and on density of female pins 505. The end pieces 571, 572 may be adhesively bonded to the center piece 570 or may be formed with the center piece 570 in a modular mold. As evident from FIGS. 15A and 15B, end pieces 571 and 572 may be connected together to form a connector housing having a minimum length and minimum number of contacts.

The modular connector shown in FIGS. 15A and 15B may be manufactured by molding the end pieces 571, 572 as a single connector housing. The single connector housing may then be cut in half to form the end pieces 571 and 572. A separately molded center piece 570 may then be bonded to the end pieces 571, 572. Of course, male connector 510 may be formed with a modular design similar to that discussed above.

Figure 15C:
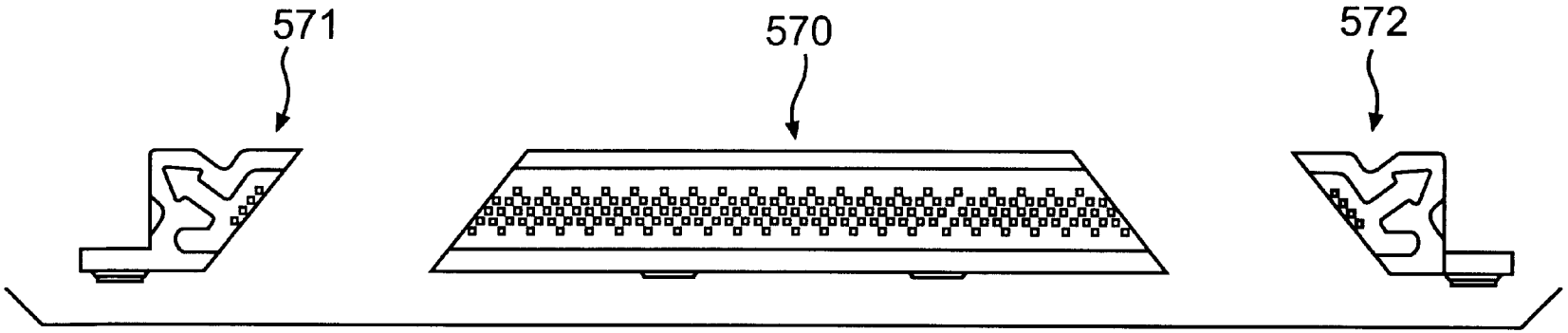
FIG. 15C illustrates a further embodiment of a modular design of the female connector housing.

FIG. 15C illustrates a second embodiment of the female connector housing having a modular design. Unlike the embodiment shown in FIGS. 15A and 15B, the end pieces 571, 572 shown in FIG. 15C have angled sides for joining to the center piece 570. The center piece 570 has angled sides that are complementary to the angled sides of the end pieces 571, 572. Because of the angled sides, the end pieces 571, 572 cannot be joined together to form a female housing. Of course, the angled sides of end pieces 571, 572 may be complementary to permit joining together.

Figure 16B:
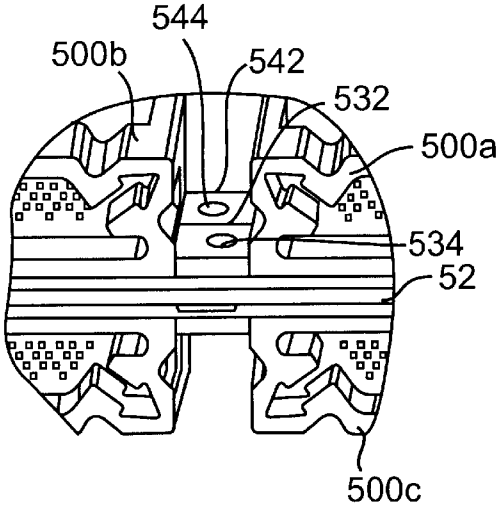
FIGS. 16A and 16B illustrate a series of female connectors mounted on opposite sides of a printed circuit board.
Figure 16A:
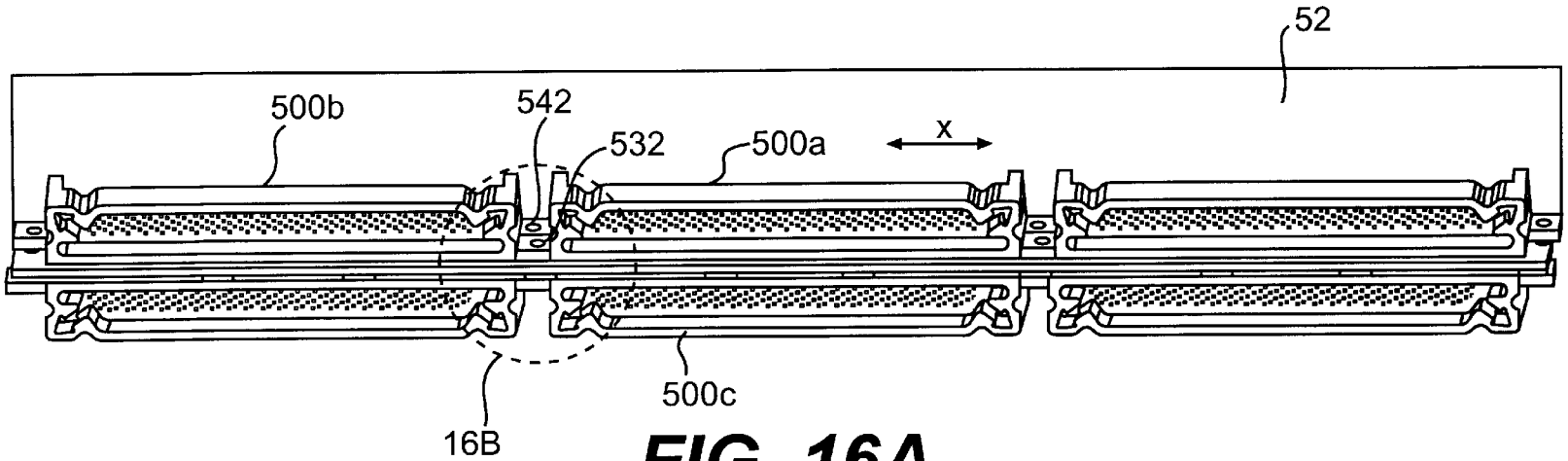
Figure 17:
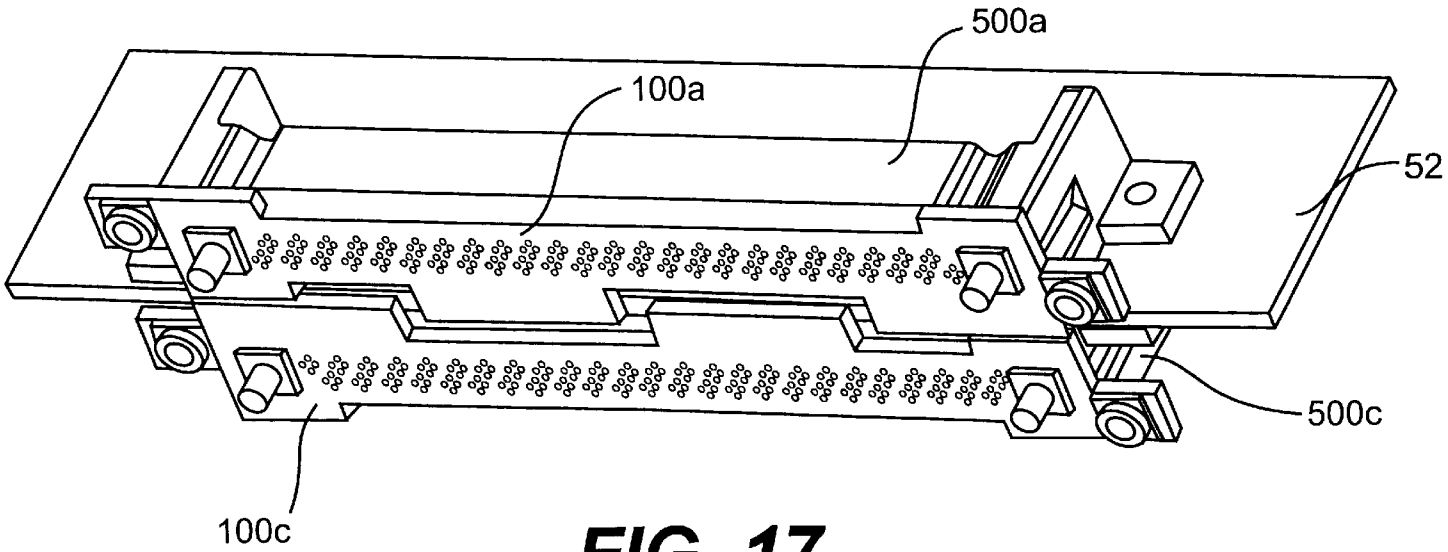
FIGS. 17, 18, 19, and 20 illustrate various views of the mating connection between the male connectors and the female connectors.
Figure 18:
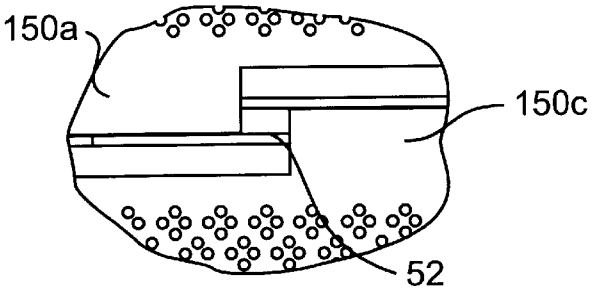

FIGS. 16A and 16B illustrate female connectors 500 mounted on opposite sides of a printed circuit board 52. As shown, the female connectors 500 are nested or merged in the x direction (i.e., end-to-end) so that more connections may be provided along a given length of the substrate edge. By way of example, hold-down tab 532 of female connector 500*a* nests or merges with hold-down tab 542 of female connector 500*b* such that the rows of female pins or rows of clusters of female pins of both connectors are aligned. Female connector 500*c* is mounted to the opposite side of printed circuit board 52 from female connector 500*a* such that the female pins or clusters of female pins are aligned, for example, such that the holes align top to bottom.

Moreover, the holes 534, 544 of the female connectors may be aligned so that a single fastener may be used to secure multiple female connectors to the printed circuit board 52 or other substrate. For example, hole 544 of female connector 500*b* may be aligned with hole 544 of female connector 500*c* so that a single fastener (e.g., a bolt and nut) may be used to couple the respective hold-down tabs of female connectors 500*b* and female connector 500*c* to the printed circuit board 52.

Figure 19:
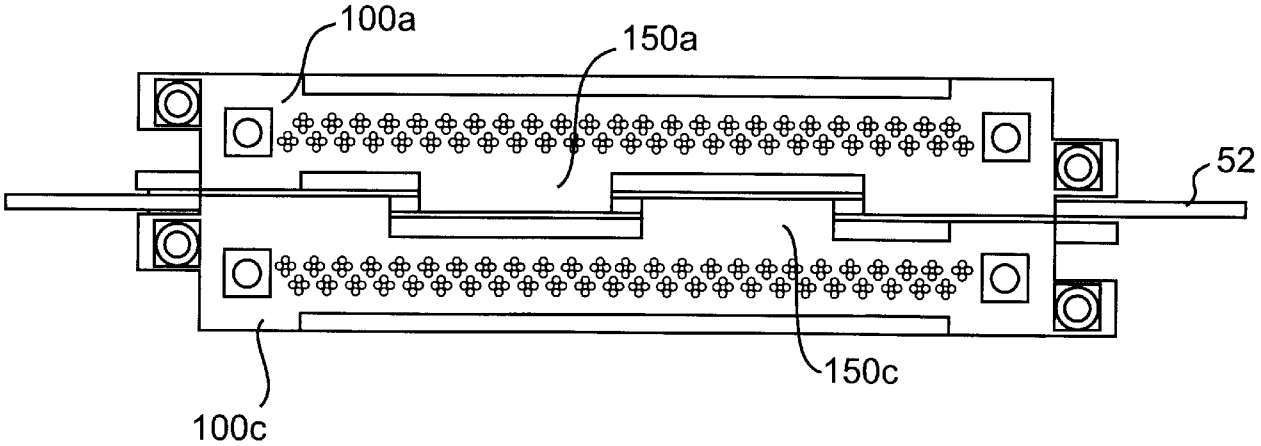
Figure 20:
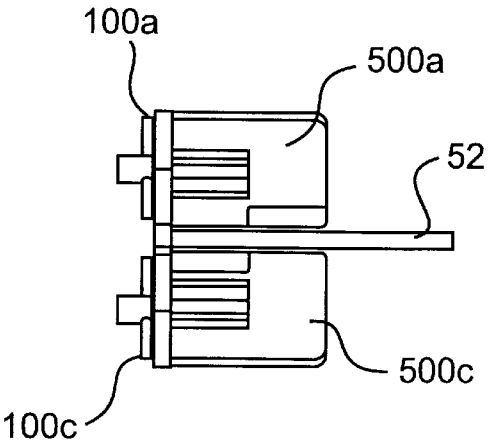

FIGS. 17–20 illustrate various views of the mating connection between the male connectors 100*a*, 100*c* and the female connectors 500*a*, 500*c*. The printed circuit board 50 to which the male connectors 100*a*, 100*c* are attached is omitted for clarity. As shown in FIG. 19, printed circuit board 52 abuts against stop members 150*a*, 150*c*, respectively, of male connectors 100*a*, 100*c* to provide a positive stop against further insertion and to stabilize the printed circuit board 52 against rocking.

Figure 21:
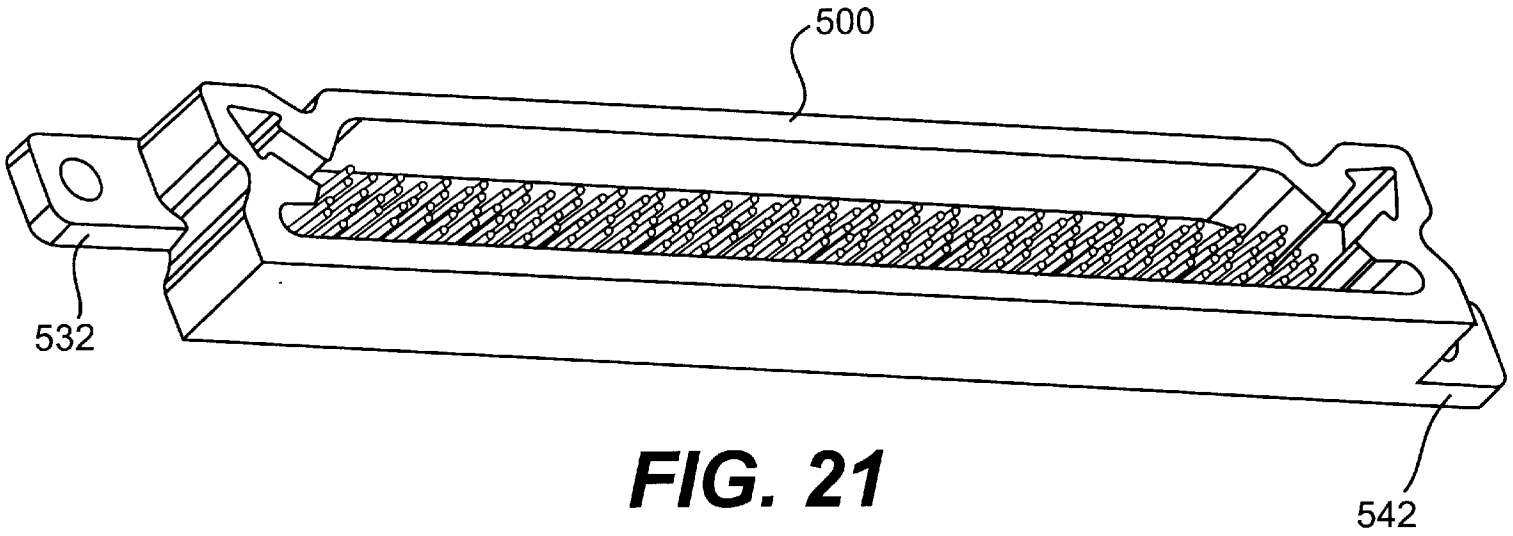
FIGS. 21 and 22 shows an alternative embodiment of a female connector adapted for vertical mounting on the surface of a printed circuit board.
Figure 22:
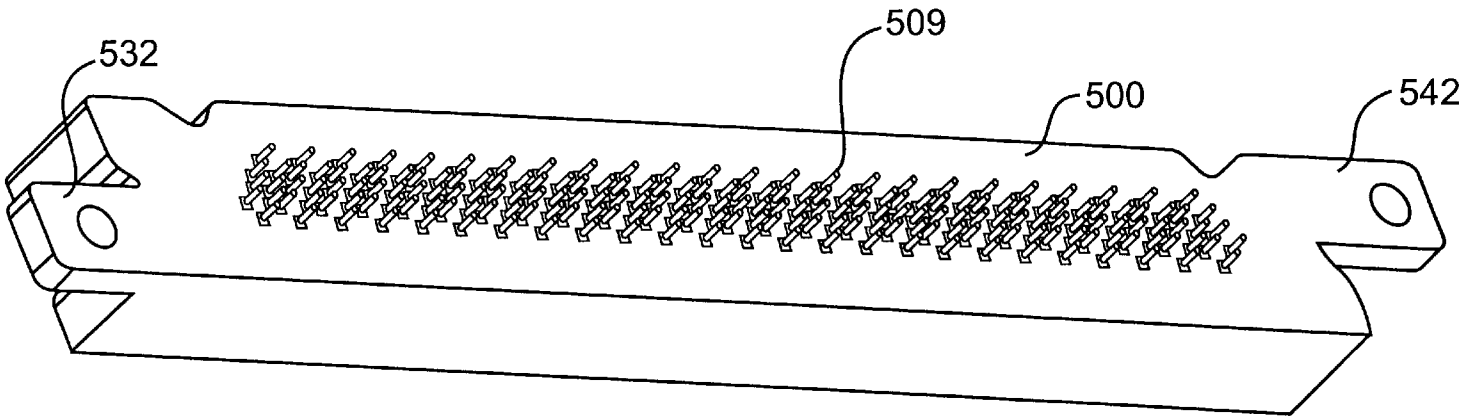
Figure 25:
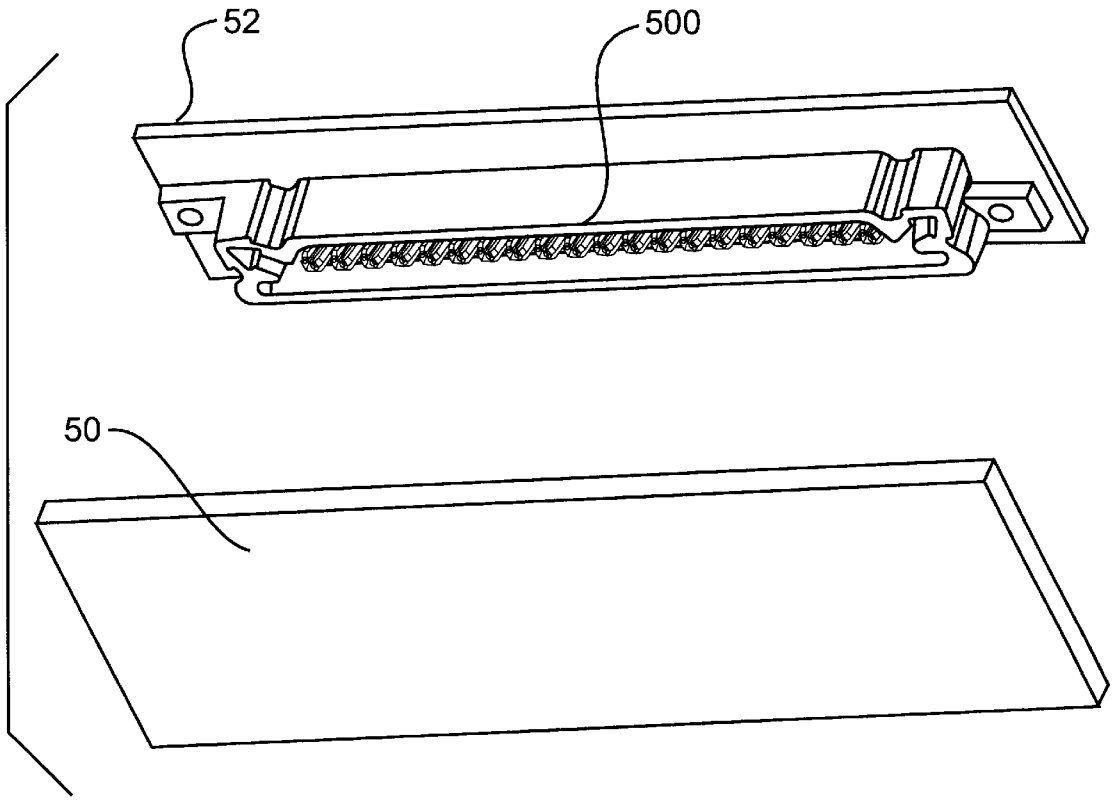

FIGS. 21 and 22 show an alternative embodiment of female connector 500 adapted for vertical mounting on the surface of a printed circuit board. FIG. 22, for example, illustrates that the tail 509 of the female pins 505 do not include an elbow section or a vertically-extending section. In this respect, the tail 509 of the female pins 505 is similar to the tail 109 of the male pins 105. As shown in FIG. 21, hold-down tabs 532, 542 are rotated about 90° from the position shown in the edge-mounted embodiment. The stand-offs and guide sleeves are omitted for simplicity. A vertical mounted male connector 100, such as that shown in FIGS. 4–8, for example, may be connected to a vertical mounted female connector 500. FIGS. 23, 24, and 25 illustrate a vertical mounted male connector 100 for connection to a vertical mounted female connector 500.

Of course, the hold-down tabs 132, 142 and male pins 105 of male connector 100 may be modified to permit edge mounting similar to, for example, the female connector housing and female pins discussed above. Further, the vertical-mounted female connector housing 500 may include a stop plate 150 and/or side edge portion 130-1, as described above in connection with the vertical-mounted male connector housing 100. Such stop plate 150 and/or side edge portion 130-1 may be used to support connection of the edge-mounted male connector housing.

Figure 26:
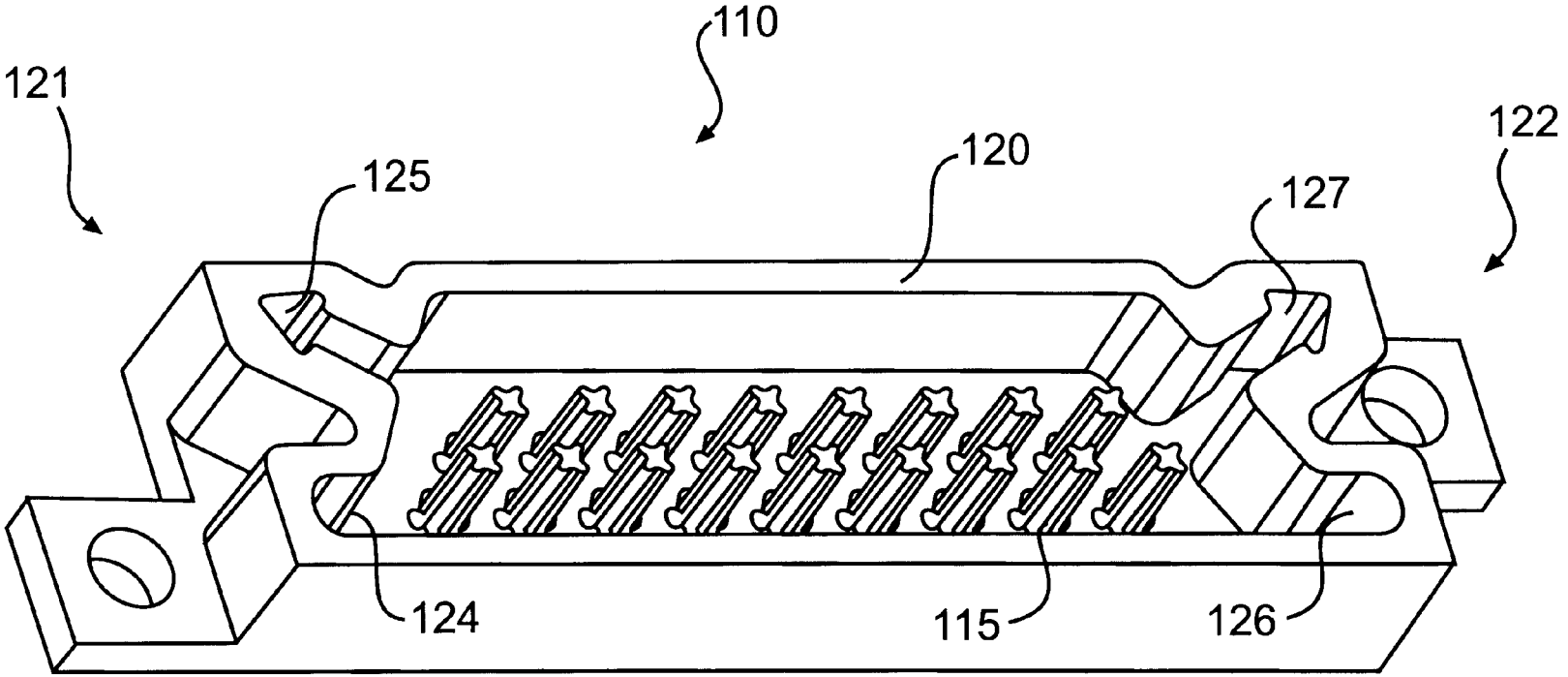
FIG. 26 illustrates a further embodiment of the male connector housing.

FIG. 26 illustrates a further embodiment of the male connector housing 110 in accordance with the present invention. The male connector housing 110 shown in FIG. 26 is generally similar to the male connector housing shown in FIGS. 4–8. For example, it may include stand-offs and/or guide posts. However, the male connector housing 110 includes a side wall 120 similar to the side wall 520 shown above in connection with FIGS. 10–14. In particular, an end 121 of side wall 120 defines a rounded space or void 124 and an arrow-shaped space of void 125, and end 122 of side wall 120 defines a rounded space or void 126 and an arrow-shaped space or void 127. Of course, as described above, the polarization/keying features may point in other directions and/or embody some other asymmetrical arrangement to ensure that mating between the male connector 100 and the female connector 500 occurs in only one orientation. In addition, the side wall 120 may comprise metallic shielding embedded in a polymeric material.

Figure 27A:
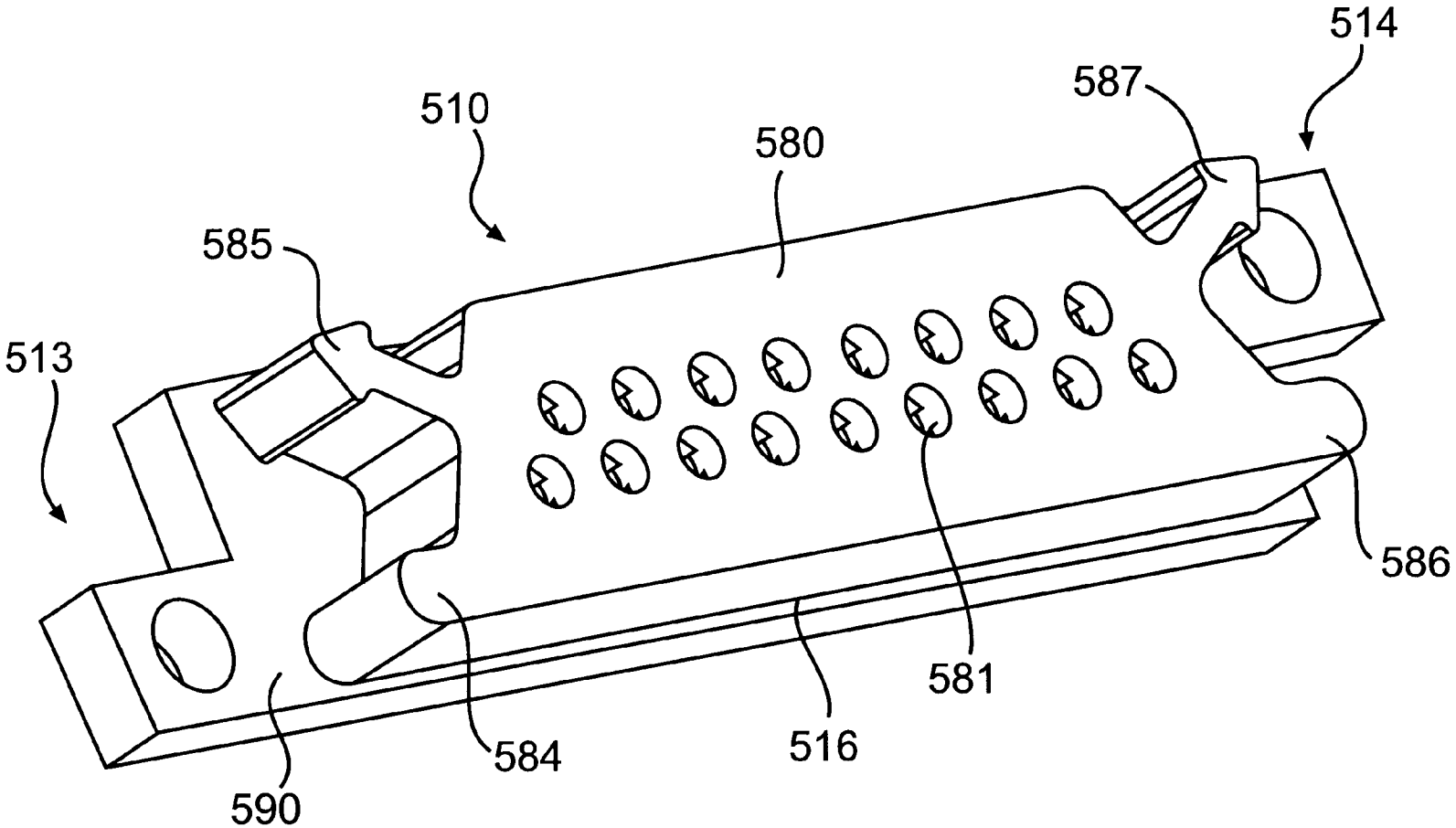
FIG. 27A and 27B illustrate a further embodiment of the female connector housing having a detachable polarization cap.
Figure 27B:
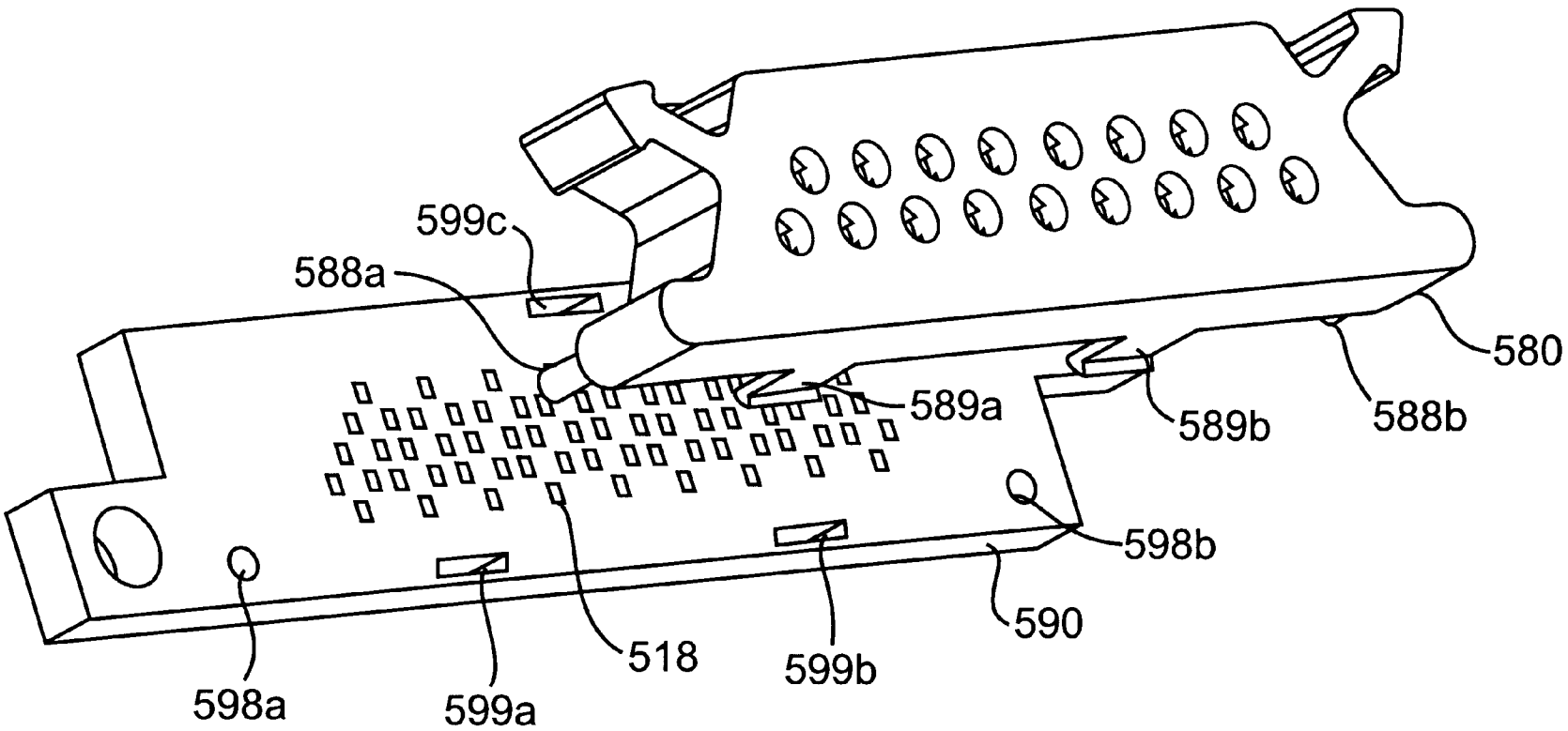
Figure 27C:
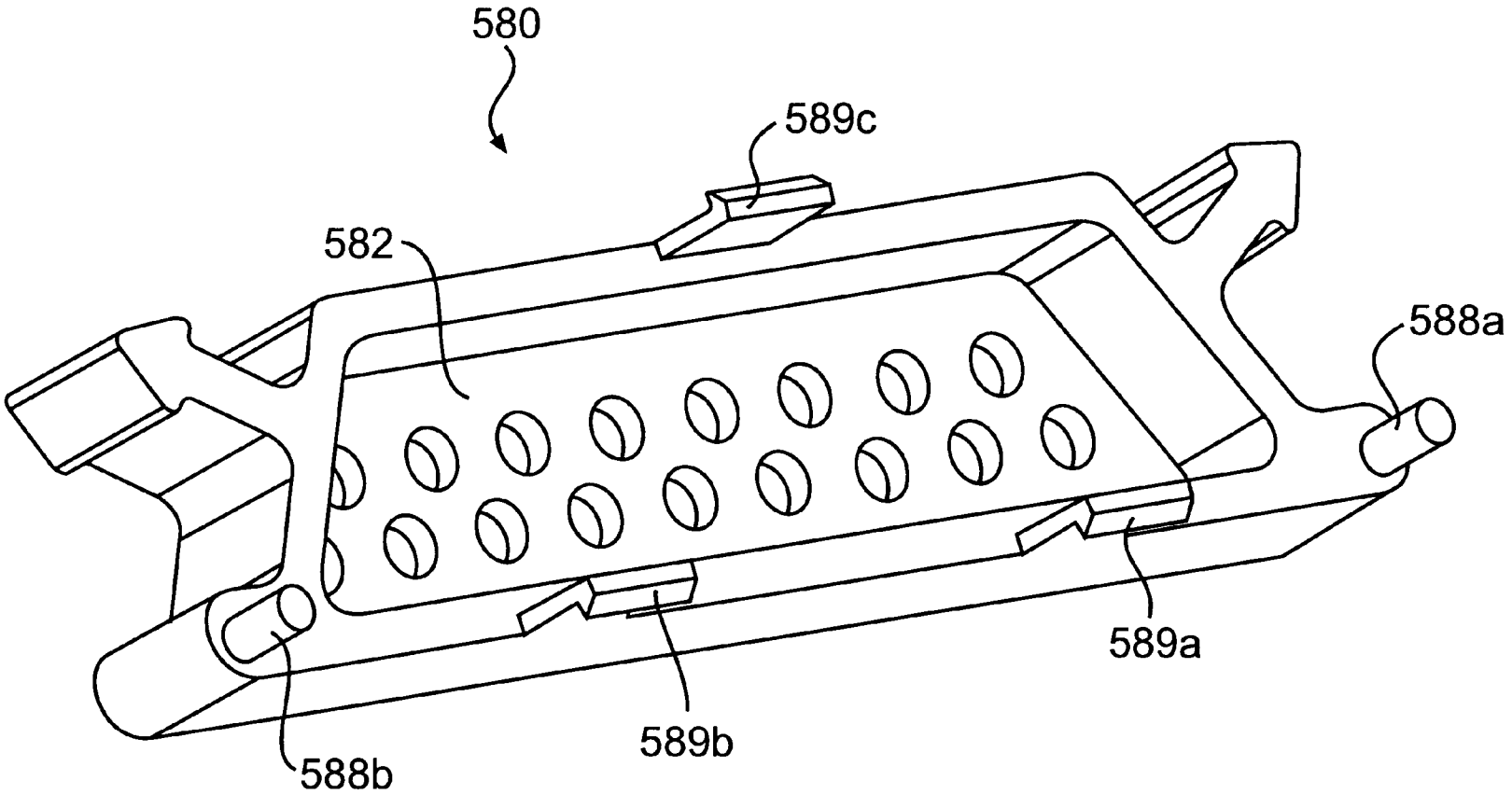
FIG. 27C illustrates the back of the detachable polarization cap.

FIGS. 27A, 27B, and 27C illustrate a further embodiment of the female connector housing 510 having a mounting plate 590 and a detachable polarization cap 580 formed on a top face 516 of the mounting plate 590. The polarization cap 580 includes apertures 581 for receiving male buttresses 115. As shown in best in FIG. 27C, the polarization cap 580 may include a hollow 582 in which the female pins 505 are located. The polarization cap 580 includes a rounded projection 584 and an arrow-shaped projection 585 at one end 513 and a rounded projection 586 and an arrow-shaped projection 587 at an opposite end 514. Of course, a variety of other polarization features and arrangements may be provided in place of or in addition to the polarization features shown in FIGS. 27A and 27B, as discussed above.

The height of the polarization cap 580 may be selected to provide a positive stop between the male connector housing 110 and the female connector housing 510. Alternatively, one or more stop plates may be provided in the manner described above in connection with FIGS. 3–8. The polarization cap may be formed of a polymeric material, e.g., the same material as the female connector housing, and may include metallic shielding embedded therein. The polarization cap 580 or portions thereof may be formed entirely of metal.

FIG. 27B shows that mounting plate 590 includes holes 518 for retaining female contact pins 505. Mounting plate 590 may also include guide holes 598*a,* 598*b* and receiving slots 599*a,* 599*b,* and 599*c*. The guide holes 598*a,* 598*b* are adapted to receive guide posts 588*a,* 588*b,* respectively, of the polarization cap 580. Receiving slots 599*a,* 599*b,* and 599*c* receive clips 589*a,* 589*b,* and 589*c,* respectively, for retaining the polarization cap 580 to the mounting plate 590. The guide holes and guides posts are optional, and other means, such as screws, rivets, adhesives, and/or other snap-on connectors, may be used to retain the polarization cap 580 to the mounting plate 590.

Figure 28A:
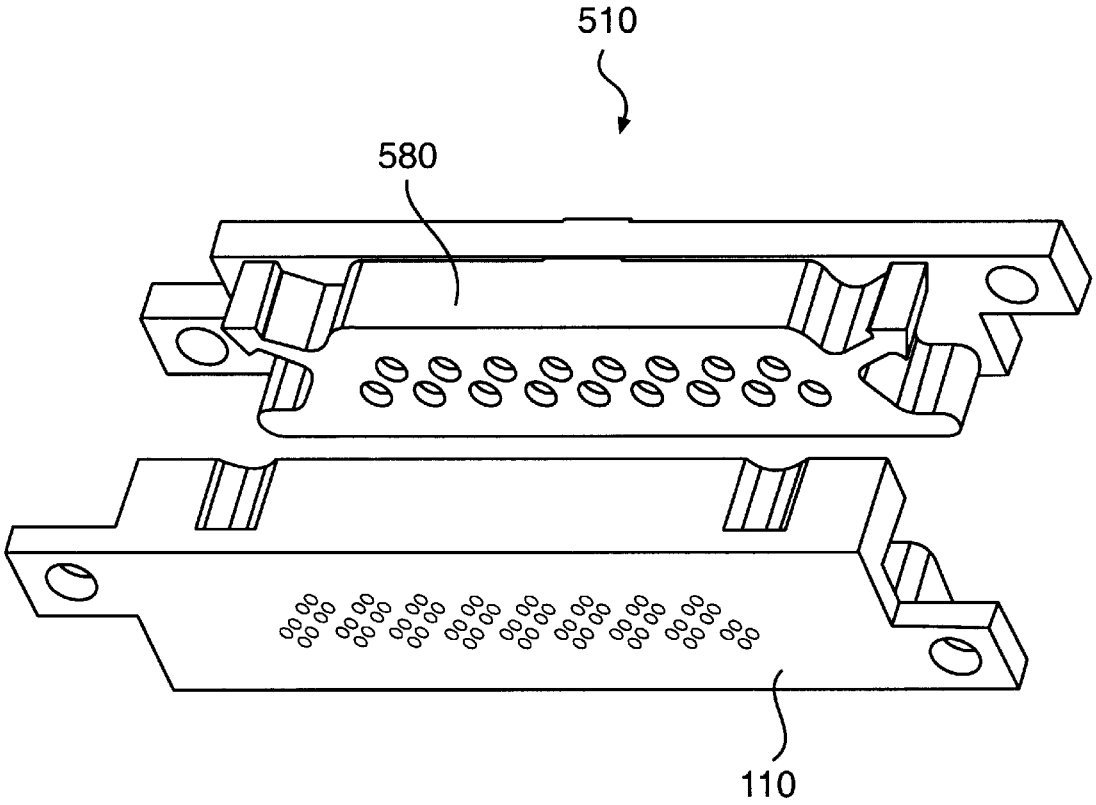
FIG. 28A illustrates the mating connection between the male connector housing shown in FIG. 26 and the female connector housing having the detachable polarization cap shown in FIG. 27C.

FIG. 28A illustrates the mating connection between the male connector housing 110 shown in FIG. 26 and the female connector housing 510 having the detachable polarization cap 580 shown in FIG. 27C. Side wall 120 of the male connector housing 110, including rounded spaces 124, 126 and arrow-shaped spaces 125, 127, receive the polarization cap 580 of the female connector housing 510, including its rounded projections 584, 586 and its arrow-shaped projections 585, 587. The combination of these features serves to guide the male and female connectors into proper alignment for mating and to prevent mating at an improper angle, at an offset, or both.

Figure 28B:
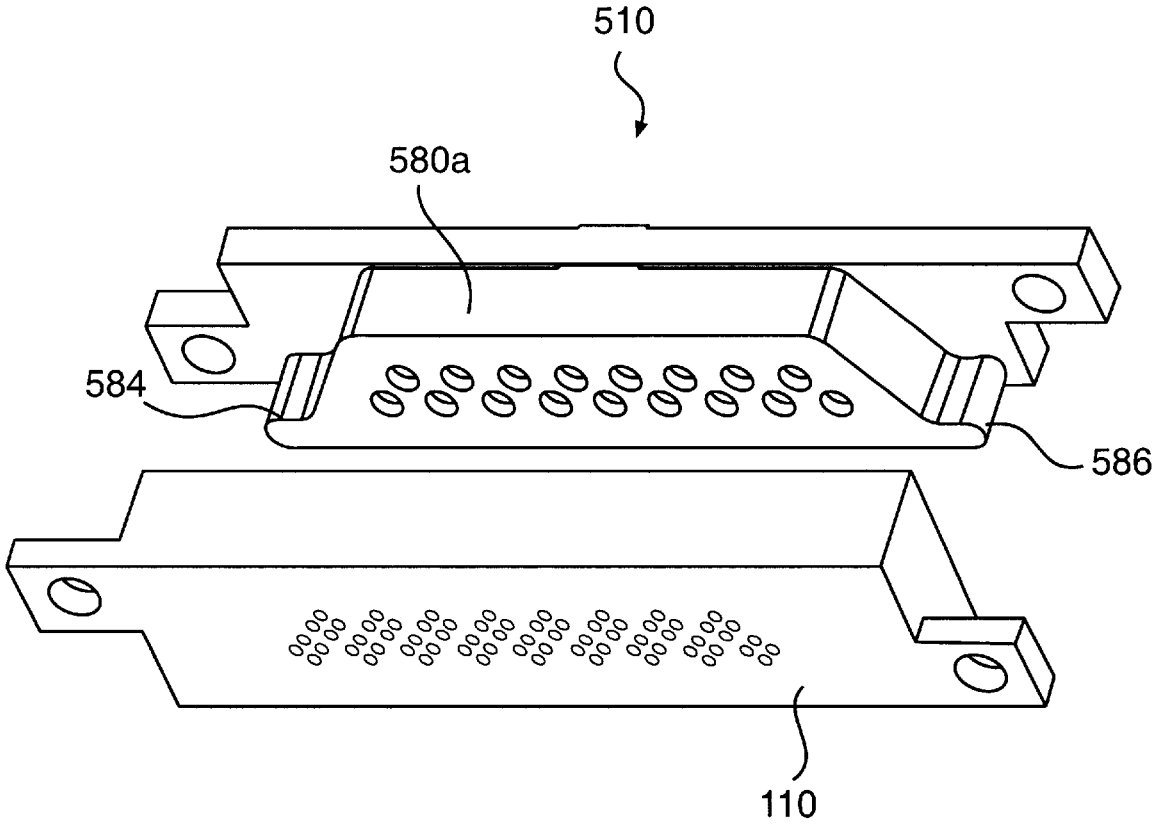
FIG. 28B illustrates the mating connection between the male connector housing shown in FIG. 26 and a further embodiment of a female connector housing having a detachable polarization cap.

FIG. 28B illustrates the mating connection between the male connector housing 110 shown in FIG. 26 and a further embodiment of a female connector housing 510 having a detachable polarization cap 580*a*. In this case, the polarization cap 580*a* includes only rounded projections 584, 586. FIG. 28B illustrates two important concepts. First, FIG. 28B illustrates that different polarization caps may be interchangeable on the mounting plate depending, for example, on the use made of the connector. Second, polarization cap 580*a* shown in FIG. 28B may be mated with a male connector housing 110 having a side wall 120 defining both rounded spaces 124, 126 and arrow-shaped spaces 125, 127, as shown in FIG. 26. Alternatively, the polarization cap 580*a* may be mated with a male connector defining only rounded spaces 124, 126. The polarization cap 580 shown in FIG. 28A, for example, may only be mated with a male connector housing 110 having a side wall 120 with both rounded spaces and arrow-shaped spaces, as shown in FIG. 26. Thus, by defining different polarization arrangements and various subsets thereof, hierarchies of matable connector combinations may be defined. For example, the various subsets may define different functional attributes. Of course, the polarization features of the polarization cap 580*a* illustrated in FIG. 28B may be made unique such that the polarization cap 580*a* may be coupled only to a single polarization type of female connector housing.

It will be apparent to those skilled in the art that various modifications and variations can be made in the male and female connectors of the present invention without departing from the scope or spirit of the invention. For example, the male and female connector housings 110, 510 may include power and/or ground connectors as an alternative or in addition to the polarization features. In this regard, hierarchies of matable connectors may be defined such that a 5 V power connection is established through one polarization feature (e.g., an arrow-shaped void at a first end of the connector housing) and a 3.3V power connection is established though another polarization feature (e.g., an arrow-shaped void at a second end of the connector housing). Accordingly, the connector housing would support applications having 5 V power requirements, 3.3 V power requirements, and both 5 V and 3.3 V power requirements. Moreover, the side wall 120, including the polarization features, of the male connector housing 110 shown in FIGS. 3–8 and in FIG. 26 may be detachable in the same manner as described above in connection with the polarization cap 580 of the female connector housing 510.

Figure 29:
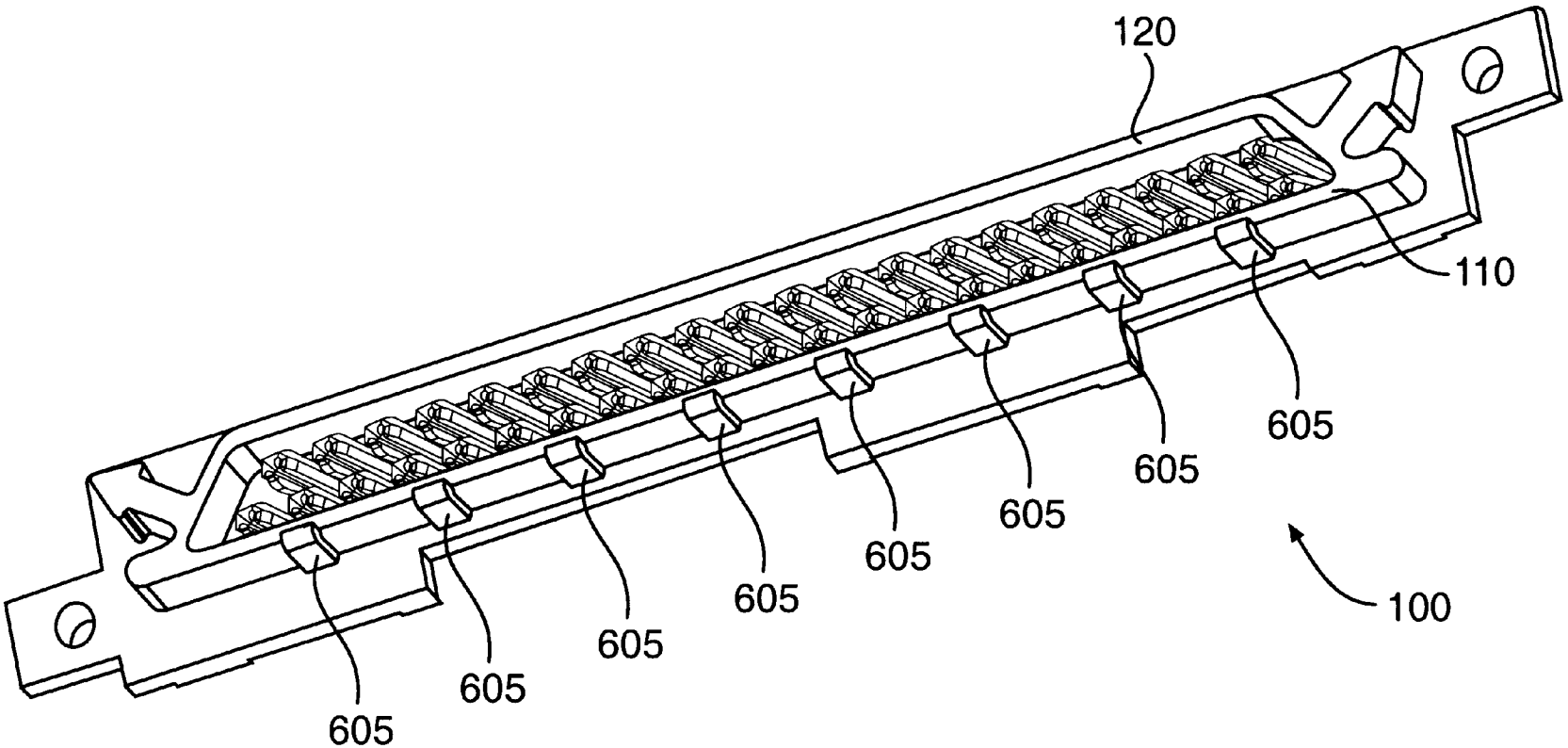
FIG. 29 illustrates an alternative embodiment of a male connector including power and/or ground leads.

FIG. 29 illustrates a further embodiment of a male connector 100 that includes a plurality of power/ground leads 605 held in the male connector housing 110. As shown, the leads 605 are arranged on an exterior side surface of the side wall 120. The leads 605 may extend through the back of the male connector housing 110 for connection to a printed circuit board or other substrate. In this regard, individual ones of the leads 605 may be connected via surface mounting or through holes to a ground line or a power supply line on a printed circuit board or other substrate. Some of the leads 605 may be connected to ground lines and others to power lines or, alternatively, all of the leads may be connected to ground lines or to power lines. The leads 605 may be larger that the male contact pins 105, as shown, to support a larger current carrying capacity.

Figure 30:
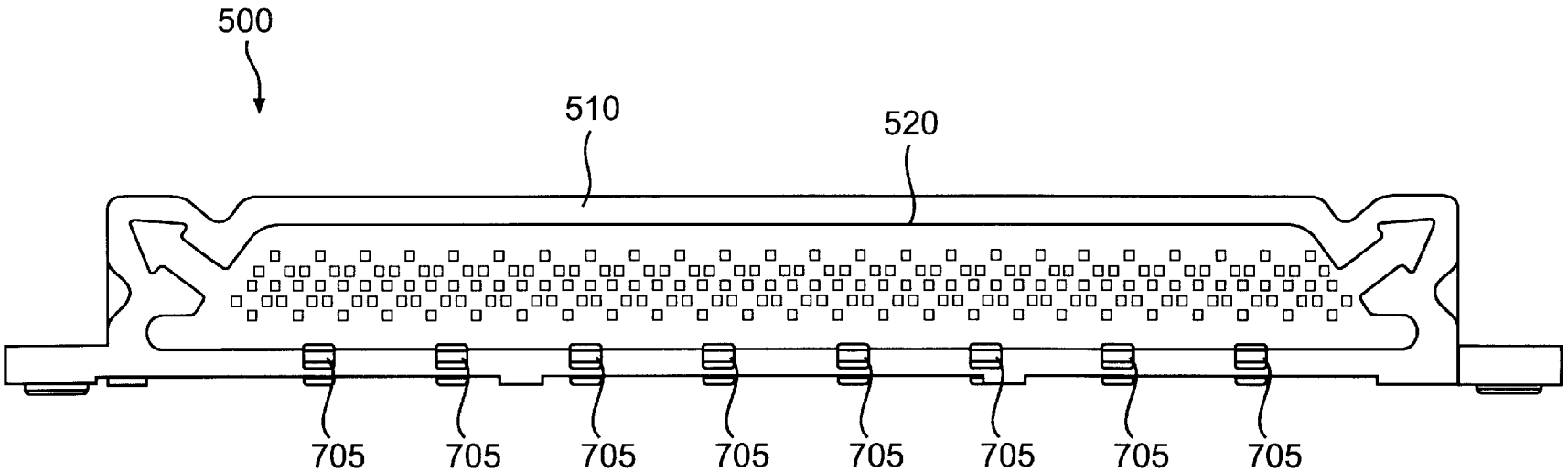
FIG. 30 shows an alternative embodiment of a female connector including power and/or ground leads.

FIG. 30 illustrates a further embodiment of a female connector 500 including a plurality of power/ground leads 705 held in the female connector housing 510. The leads 705 are arranged on an interior side surface of the side wall 520 to facilitate mating with corresponding power/ground leads 605 held in the male connector housing 110. The leads 705 may extend through the back or bottom of the female connector housing 510 to enable connection to a printed circuit board or other substrate. Similar to the power/ground leads 605, individual ones of the leads 705 may be connected via surface mounting or through holes to a ground line or a power supply line on a printed circuit board or other substrate. The leads 705 may be larger that the female contact pins 505, as shown, to support a larger current carrying capacity. Distributing power and/or ground line connections along the length of the male and female connector housings 110, 510 results in improved power/ground distribution and redundancy in mating contacts.

Figure 31:
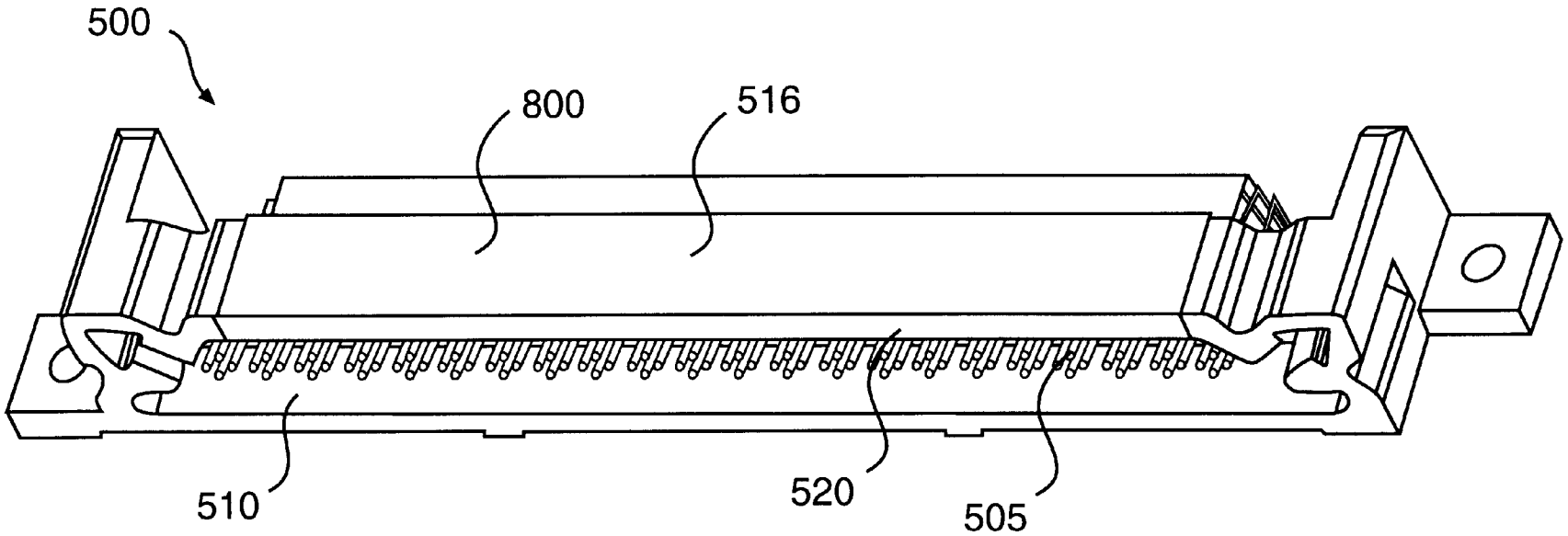
FIGS. 31, 32, and 33 illustrate an embodiment of the female electrical connector having shielding for shielding against noise or other interference.
Figure 32:
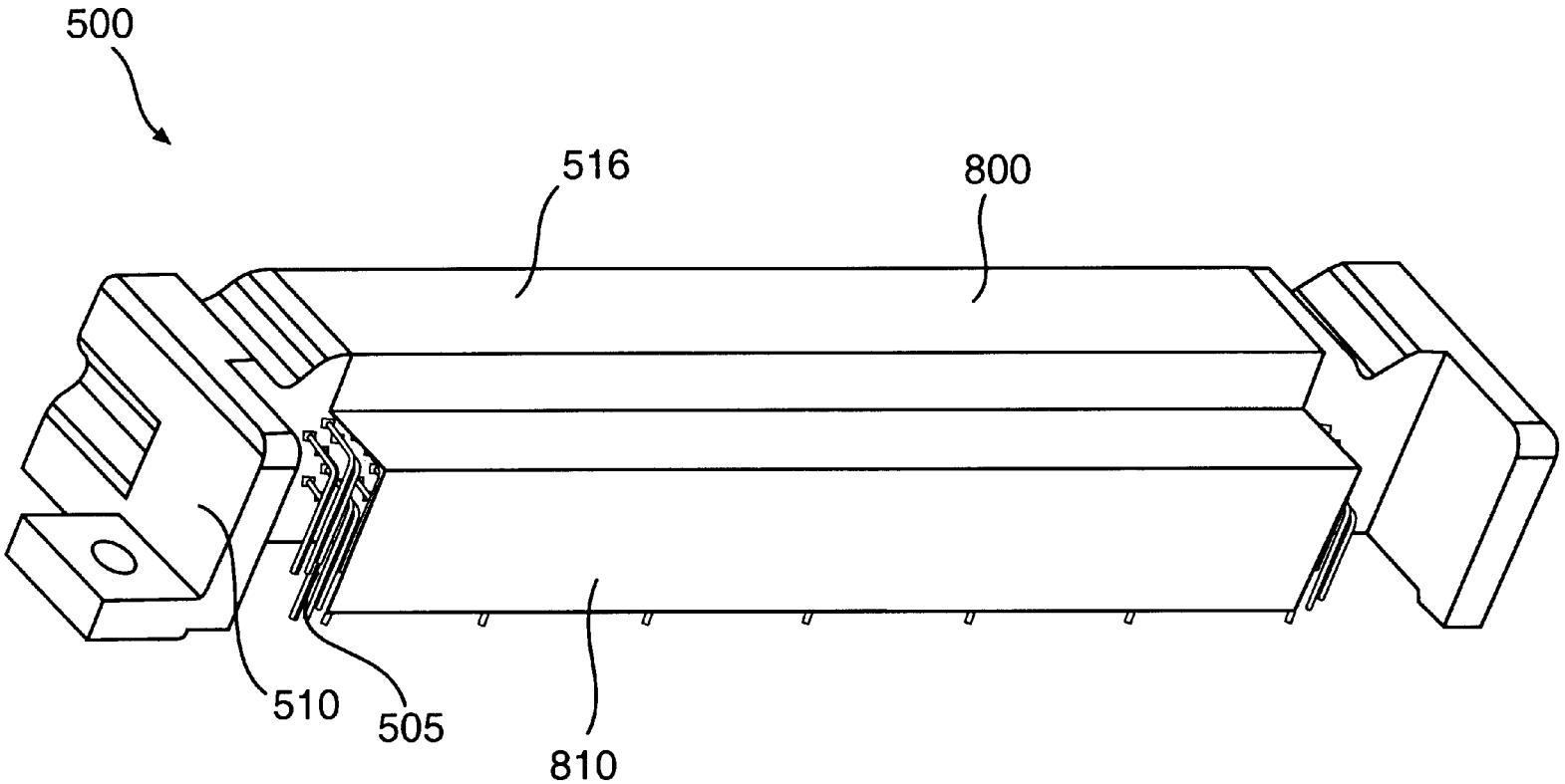
Figure 33:
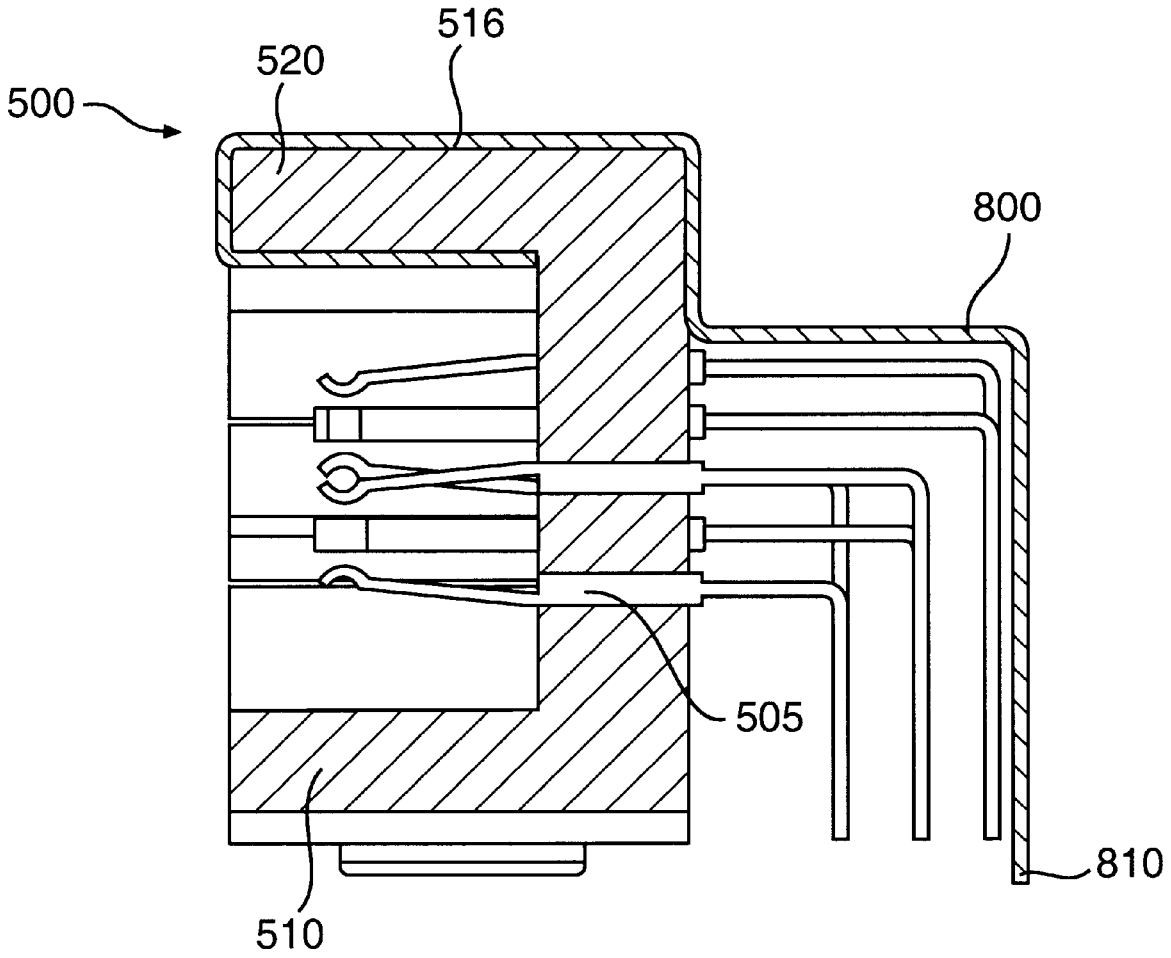

FIGS. 31, 32, and 33 illustrate an embodiment of the female electrical connector 500 having shielding 800 for shielding against noise or other interference that may be imposed on the electrical signals carried by the female contact pins 505. As shown, metallic shielding 800 covers an interior and exterior surface of the side wall 520, extends over the top 516 of the connector housing 510, and covers the tail portions of the female contact pins 505. The end 810 of the shielding 800 may be electrically connected to the surface of the printed circuit board or other substrate. Of course, the shielding 800 may be provided to continuously surround the female contact pins 505 to provide an added measure of shielding.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrical connector for mounting to a substrate, comprising:

an insulative connector housing having a longitudinal axis a first side, a second side opposite the first side, a first end, and a second end opposite the first end, the first and second ends including first and second longitudinally extending hold-down tabs, respectively, adapted to sit on the surface of the substrate to mount said insulative connector housing to the substrate, said first hold-down tab located proximal the first side and said second hold-down tab located proximal the second side such that said first and second hold-down tabs are located diagonally only on opposite sides of said longitudinal axis respectively; and a plurality of contact pins held in the insulative connector housing.

2. An electrical connector according to claim 1, wherein said first hold-down tab is closer to the first side than the second side, and said second hold-down tab is closer to the second side than the first side.

3. An electrical connector according to claim 1, wherein said insulative connector housing further includes a stop plate extending laterally from the first side.

4. An electrical connector according to claim 1, wherein said insulative connector housing further includes a side wall disposed around said contact pins.

5. An electrical connector according to claim 4, wherein said insulative connector housing further includes a stop plate having first and second edge portions extending from said side wall and an end portion parallel to said side wall.

6. An electrical connector according to claim 5, wherein said stop plate includes at least one stand off on a mounting surface thereof.

7. An electrical connector according to claim 4, wherein said side wall comprises at least one polarization feature.

8. An electrical connector according to claim 7, wherein said at least one polarization feature comprises an arrow-shaped projection.

9. An electrical connector according to claim 7, wherein said at least one polarization feature comprises an arrow-shaped space defined by an interior surface of said side wall.

10. An electrical connector according to claim 1, wherein said insulative connector housing comprises metallic shielding embedded in a polymer material.

11. An electrical connector according to claim 1, wherein said insulative connector housing comprises a top face and a plurality of discrete buttresses extending from the top face, said contact pins being arranged in clusters around said buttresses.

12. An electrical connector according to claim 11, wherein said insulative connector housing further comprises a side wall extending from the top face and surrounding said buttresses.

13. An electrical connector according to claim 12, wherein said side wall comprises a first arrow-shaped projection adjacent the first end of the insulative connector housing and a second arrow-shaped projection adjacent the second end of the insulative connector housing, wherein said first and second arrow-shaped projections generally point toward the first side of the insulative connector housing.

14. An electrical connector according to claim 1, wherein:

the first and second sides comprise a top and a bottom, respectively, said insulative connector housing further comprises a front face, and said contact pins extend from the front face in an array of clusters, wherein each cluster of contact pins is adapted to receive a corresponding cluster of pins to establish an electrical connection.

15. An electrical connector according to claim 14, wherein said insulative housing further comprises a side wall on the front face, said side wall surrounding the contact pins.

16. An electrical connector according to claim 15, wherein said side wall defines a first arrow-shaped space adjacent the first end of the connector housing and a second arrow-shaped space adjacent the second end of the connector housing, wherein said first and second arrow-shaped spaces generally point toward the top of the connector housing.

17. An electrical connector according to claim 1, wherein at least one of said first and second hold-down tabs is configured to nest with a hold-down tab of another connector housing for mounting adjacent to said insulative connector housing on the substrate, thereby facilitating conservation of space on the substrate.

18. An electrical connector according to claim 1, wherein said plurality of contact pins are held in said insulative connector housing in at least one row and wherein at least one of said first and second hold-down tabs is adapted to laterally overlap with a complementary hold-down tab of another electrical connector such that said at least one row of contact pins aligns with a corresponding row of contact pins of said another electrical connector.

19. An electrical connector according to claim 1, wherein said plurality of contact pins are held in said insulative connector housing in at least one row of contact pins and wherein the first end of said insulative connector housing is adapted to merge with a complementary end of another electrical connector, such that said at least one row of contact pins is aligned with a corresponding row of contact pins of said another electrical connector.

20. An electrical connector according to claim 1, wherein the first end of said insulative connector housing is adapted for end-to-end nesting with an end of another insulative connector housing.

21. An electrical connector according to claim 1, wherein said insulative connector housing comprises separate first and second end pieces and a separate center piece, said end pieces being coupled to opposite ends of said center piece.

22. An electrical connector according to claim 1, further comprising a polarization cap detachably connected to said insulative connector housing, said polarization cap having one or more polarization features.

23. An electrical connector according to claim 22, wherein said polarization cap has a plurality of holes configured for receiving contact pins of another electrical connector for contact with said contact pins.

24. An electrical connector according to claim 22, wherein said polarization cap comprises a hollow for housing said contact pins.

25. An electrical connector according to claim 22, wherein an outer periphery of said polarization cap defines said one or more polarization features.

26. An electrical connector according to claim 25, wherein said one or more polarization features comprises an arrow-shaped projection.

27. An electrical connector according to claim 25, wherein said one or more polarization features comprises a rounded projection.

28. An electrical connector according to claim 25, wherein said one or more polarization features comprises an arrow-shaped projection and a rounded projection.

29. An electrical connector according to claim 22, wherein said polarization cap comprises a plurality of clips adapted for detachably connecting to the electrical insulative housing.

30. An electrical connector assembly, comprising:

a male connector comprising a male connector housing having a first longitudinal axis and a plurality of male contact pins held in said male connector housing in at least one row, said male connector housing having first and second longitudinally extending mounting extensions adapted to sit on the surface of a first substrate to mount said male connector housing to the first substrate, said first and second mounting extensions being located diagonally only on opposite sides of said first longitudinal axis respectively; and a female connector comprising a female connector housing having a second longitudinal axis, and a plurality of female contact pins held in said female connector housing in at least one row, said female connector housing having first and second longitudinally extending mounting extensions adapted to sit on the surface of a second substrate to mount said female connector housing to a side of the second substrate, said first and second mounting extensions of said female connector housing being located diagonally only on opposite sides of said second longitudinal axis respectively, wherein at least a portion of said male connector is adapted to be received within said female connector such that said male contact pins contact said female contact pins to establish an electrical connection therebetween.

31. The electrical connector assembly according to claim 30, wherein said male connector housing includes a polarization feature and said female connector housing includes a complementary polarization feature, whereby electrical connection between the male connector and the female connector may occur in one orientation of the male and female connector housings.

32. The electrical connector assembly according to claim 31, wherein said polarization feature of said male connector housing comprises an arrow-shaped projection and wherein said polarization feature of said female connector housing comprises an arrow-shaped space.

33. The electrical connector assembly according to claim 30, wherein said male connector comprises a first male connector and said female connector comprises a first female connector, and further comprising:

a second male connector comprising a second male connector housing and a plurality of male contact pins held in said second male connector housing in at least one row, said second male connector housing having first and second staggered mounting extensions for mounting said second male connector housing to the first substrate, wherein said first mounting extension of said first male connector housing and said second mounting extension of said second male connector housing nest together when mounted to the first substrate such that said at least one row of contact pins of said first male connector aligns with said at least one row of contact pins of said second male connector; and a second female connector comprising a second female connector housing and a plurality of female contact pins held in said second female connector housing in at least one row, said second female connector housing having first and second staggered mounting extensions for mounting said second female connector housing to the side of the second substrate, wherein said first mounting extension of said first female connector housing and said second mounting extension of said second female connector housing nest together when mounted to the side of the second substrate such that said at least one row of contact pins of said first female connector aligns with said at least one row of contact pins of said second female connector, wherein at least a portion of said second male connector is adapted to be received within said second female connector such that said male pins of said second male connector contact said female pins of said second female connector to establish an electrical connection therebetween.

* * * * *